US008028532B2

(12) United States Patent
Voute et al.

(10) Patent No.: US 8,028,532 B2
(45) **Date of Patent: *Oct. 4, 2011**

(54) SYSTEMS AND METHODS FOR FREEZING, STORING AND THAWING BIOPHARMACEUTICAL MATERIALS

(75) Inventors: Nicolas Voute, Cuges les Pins (FR); Eric K. Lee, Acton, MA (US); Dimitry Yakoushkin, Petaluma, CA (US)

(73) Assignee: Sartorius Stedim North America Inc., Bohemia, NY (US)

( * ) Notice: Subject to any disclaimer, the term of this patent is extended or adjusted under 35 U.S.C. 154(b) by 445 days.

This patent is subject to a terminal disclaimer.

(21) Appl. No.: 11/682,558

(22) Filed: Mar. 6, 2007

(65) Prior Publication Data

US 2007/0240432 A1 Oct. 18, 2007

Related U.S. Application Data

(60) Provisional application No. 60/779,823, filed on Mar. 6, 2006.

(51) Int. Cl.
*F25C 1/00* (2006.01)

(52) U.S. Cl. ..... 62/66

(58) Field of Classification Search ..... 62/66, 356; 220/84, 256, 259, 339, 507, 510, 522; 206/5.1; 248/911–913; 224/257; 38/102.2; 277/165
See application file for complete search history.

(56) References Cited

U.S. PATENT DOCUMENTS

| | | | | |
|---|---|---|---|---|
| 1,710,429 A | * | 4/1929 | Mobley | 40/781 |
| 2,068,401 A | | 1/1937 | Dromgold | |
| 2,506,448 A | | 5/1950 | Gregor | |
| 2,662,520 A | | 12/1953 | McMahon | 128/1 |
| 2,775,101 A | | 12/1956 | Hanson | 62/108 |
| 2,964,920 A | | 12/1960 | Staebler | 62/60 |
| 2,966,041 A | | 12/1960 | Zearfoss, Jr. et al. | 62/60 |

(Continued)

FOREIGN PATENT DOCUMENTS

DE 3047784 A1 7/1982

(Continued)

OTHER PUBLICATIONS

Avis et al., *Cryopreservation Applications in Pharmaceuticals and Biotechnology*, Drug Manufacturing Technology Series 5, "Large-Scale Cryopreservation: Process Development for Freezing and Thawing of Large Volumes of Cell Suspensions, Protein Solutions, and Biological Products", Wisniewski, pp. 181-197.

(Continued)

*Primary Examiner* — Frantz F Jules
*Assistant Examiner* — Emmanuel Duke
(74) *Attorney, Agent, or Firm* — Heslin Rothenberg Farley & Mesiti P.C.; Victor A. Cardona, Esq.

(57) ABSTRACT

A system for use in freezing, storing and thawing biopharmaceutical materials includes a flexible sterile container means for holding biopharmaceutical material therein and a holder more rigid than said container means. The container means is received in a cavity of the holder and the holder extends along a perimeter of the container means. The holder is fixedly connected to the container means. The holder includes opposing sides defining an opening and the container means extends between the opposing sides of the holder defining the opening. The container means includes a substantially smooth exterior surface extending between the opposing sides.

22 Claims, 20 Drawing Sheets

U.S. PATENT DOCUMENTS

| | | | | |
|---|---|---|---|---|
| 3,121,627 | A | 2/1964 | Harris | 62/58 |
| 3,389,974 | A | 6/1968 | Barattini et al. | 23/295 |
| 3,690,118 | A | 9/1972 | Rainwater | |
| 3,940,232 | A | 2/1976 | Stock | 425/447 |
| 3,952,536 | A | 4/1976 | Faust et al. | 62/293 |
| 3,959,981 | A | 6/1976 | Anderson | 62/135 |
| 4,018,911 | A | 4/1977 | Lionetti et al. | 424/101 |
| 4,030,314 | A | 6/1977 | Strehler et al. | 62/65 |
| 4,077,228 | A | 3/1978 | Schumacher et al. | |
| 4,079,529 | A * | 3/1978 | Jennen et al. | 38/102.2 |
| 4,090,374 | A | 5/1978 | Faust et al. | 62/341 |
| 4,107,937 | A | 8/1978 | Chmiel | 62/64 |
| 4,178,776 | A | 12/1979 | Baldus et al. | 62/538 |
| 4,194,369 | A | 3/1980 | Faust et al. | 62/371 |
| 4,251,995 | A | 2/1981 | Pert et al. | 62/60 |
| 4,304,293 | A | 12/1981 | Scheiwe et al. | 165/12 |
| 4,327,799 | A | 5/1982 | Scheiwe et al. | 165/2 |
| 4,336,435 | A | 6/1982 | Kashyap et al. | 219/10.55 |
| 4,469,227 | A | 9/1984 | Faust | 206/527 |
| 4,473,739 | A | 9/1984 | Scheiwe et al. | 219/302 |
| 4,484,448 | A | 11/1984 | Crabb, Jr. | |
| 4,486,389 | A | 12/1984 | Darnell et al. | 422/307 |
| 4,490,982 | A | 1/1985 | Christmas | 62/3 |
| 4,531,373 | A | 7/1985 | Rubinsky | 62/63 |
| 4,565,073 | A | 1/1986 | Lavender | 62/373 |
| 4,580,409 | A | 4/1986 | Angelier et al. | 62/340 |
| 4,584,843 | A | 4/1986 | Pronger, Jr. et al. | 62/123 |
| 4,587,810 | A | 5/1986 | Fletcher | 62/3 |
| 4,596,120 | A | 6/1986 | Knodel et al. | 62/59 |
| 4,609,036 | A | 9/1986 | Schrader | 165/10 |
| 4,652,712 | A | 3/1987 | Zeipel | 219/10.55 |
| 4,669,271 | A | 6/1987 | Noel | 62/60 |
| 4,712,607 | A | 12/1987 | Lindeman et al. | 165/30 |
| 4,720,048 | A | 1/1988 | Maroney et al. | |
| 4,793,151 | A | 12/1988 | Masel et al. | 62/306 |
| 4,799,358 | A | 1/1989 | Knopf et al. | 62/3 |
| 4,801,777 | A | 1/1989 | Auerbach | 219/10.55 |
| 4,843,827 | A | 7/1989 | Peppers | 62/73 |
| 4,852,365 | A | 8/1989 | Elrod et al. | |
| 4,874,915 | A | 10/1989 | Harms et al. | 219/10.55 |
| 4,893,670 | A | 1/1990 | Joshi et al. | 165/40 |
| 4,922,721 | A | 5/1990 | Robertson et al. | |
| 4,954,679 | A | 9/1990 | Harms et al. | 219/10.55 |
| 4,967,564 | A | 11/1990 | Strasser | 62/47.1 |
| 4,971,737 | A | 11/1990 | Infanti | 264/28 |
| 4,976,308 | A | 12/1990 | Faghri | 165/10 |
| 4,986,080 | A | 1/1991 | Grigoli et al. | 62/75 |
| 5,005,371 | A | 4/1991 | Yonezawa et al. | 62/238.6 |
| 5,022,149 | A | 6/1991 | Abbott | 29/890.048 |
| 5,022,236 | A | 6/1991 | Knippscheer et al. | 62/529 |
| 5,029,634 | A | 7/1991 | Hurner | 165/47 |
| 5,033,544 | A | 7/1991 | Abbott | 165/184 |
| 5,054,548 | A | 10/1991 | Zohler | 165/133 |
| 5,072,569 | A | 12/1991 | VanTassel | 52/745 |
| 5,090,207 | A | 2/1992 | Gilbertson et al. | 62/59 |
| 5,103,651 | A | 4/1992 | Coelho et al. | 62/341 |
| 5,125,900 | A | 6/1992 | Teves | 604/114 |
| 5,168,725 | A | 12/1992 | Margolin | 62/457.9 |
| 5,176,197 | A | 1/1993 | Hamaguchi et al. | 164/459 |
| 5,181,387 | A | 1/1993 | Meckler | 62/59 |
| 5,205,128 | A | 4/1993 | Richard | 62/63 |
| 5,212,957 | A | 5/1993 | Ruff | 62/124 |
| 5,220,954 | A | 6/1993 | Longardner et al. | 165/10 |
| 5,243,833 | A | 9/1993 | Coelho et al. | 62/376 |
| 5,285,657 | A | 2/1994 | Bacchi et al. | 62/457.9 |
| 5,332,034 | A | 7/1994 | Chiang et al. | 165/184 |
| 5,374,436 | A | 12/1994 | White et al. | 426/249 |
| 5,411,078 | A | 5/1995 | Ares | 165/113 |
| 5,458,191 | A | 10/1995 | Chiang et al. | 165/133 |
| 5,476,763 | A | 12/1995 | Bacchi et al. | 435/284.1 |
| 5,520,885 | A | 5/1996 | Coelho et al. | 422/101 |
| 5,524,706 | A | 6/1996 | Nakamura et al. | 165/47 |
| 5,535,598 | A | 7/1996 | Cothern et al. | 62/356 |
| 5,557,943 | A | 9/1996 | Coelho et al. | 62/376 |
| 5,579,830 | A | 12/1996 | Giammaruti | 165/104.27 |
| 5,582,856 | A | 12/1996 | White et al. | 426/249 |
| 5,609,035 | A | 3/1997 | Cothern et al. | 62/73 |
| 5,616,268 | A | 4/1997 | Carr | 219/687 |
| 5,626,353 | A | 5/1997 | Campbell | |
| 5,638,686 | A | 6/1997 | Coelho et al. | 62/51.1 |
| 5,644,922 | A | 7/1997 | Linden et al. | 62/51.1 |
| 5,689,961 | A | 11/1997 | Cosman | 62/78 |
| 5,750,658 | A | 5/1998 | Coelho et al. | 530/382 |
| 5,779,974 | A | 7/1998 | Kuzyk | 422/44 |
| 5,862,675 | A | 1/1999 | Scaringe et al. | 62/193.3 |
| 5,863,715 | A | 1/1999 | Rajotte et al. | 435/1.3 |
| 5,873,254 | A | 2/1999 | Arav | 62/63 |
| 5,884,490 | A | 3/1999 | Whidden | 62/70 |
| 5,939,023 | A | 8/1999 | Coelho et al. | 422/101 |
| 5,964,095 | A | 10/1999 | Coelho et al. | 62/62 |
| 5,964,100 | A | 10/1999 | Wisniewski | 62/373 |
| 5,988,422 | A | 11/1999 | Vallot | 220/62.22 |
| 5,996,427 | A | 12/1999 | Masek et al. | 73/864.91 |
| 5,999,701 | A | 12/1999 | Schmidt | 392/470 |
| 6,007,773 | A | 12/1999 | Kuzyk | 422/44 |
| 6,065,294 | A | 5/2000 | Hammerstedt et al. | 62/3.3 |
| 6,077,447 | A | 6/2000 | Coelho et al. | 210/774 |
| 6,079,215 | A | 6/2000 | Wisniewski | 62/46.1 |
| 6,098,410 | A | 8/2000 | Horigane | 62/62 |
| 6,123,696 | A | 9/2000 | Coelho et al. | 604/410 |
| 6,146,124 | A | 11/2000 | Coelho et al. | 425/387.1 |
| 6,155,071 | A | 12/2000 | Koyanagi | |
| 6,186,468 | B1 | 2/2001 | Schlegel | |
| 6,196,296 | B1 | 3/2001 | Wisniewski et al. | 165/47 |
| 6,218,796 | B1 | 4/2001 | Kozlowski | |
| 6,220,038 | B1 | 4/2001 | Marsh et al. | 62/71 |
| 6,232,115 | B1 | 5/2001 | Coelho et al. | 435/307.1 |
| 6,274,090 | B1 | 8/2001 | Coelho et al. | 422/101 |
| 6,302,327 | B1 | 10/2001 | Coelho et al. | 235/383 |
| 6,347,526 | B1 | 2/2002 | Ledbetter | |
| 6,371,121 | B1 | 4/2002 | Faries, Jr. et al. | 128/849 |
| 6,384,380 | B1 | 5/2002 | Faries, Jr. et al. | 219/385 |
| 6,387,322 | B1 | 5/2002 | Gallus | 422/38 |
| 6,393,860 | B1 | 5/2002 | Heschel et al. | 62/376 |
| 6,453,683 | B1 | 9/2002 | Wisniewski et al. | 62/75 |
| 6,631,616 | B2 | 10/2003 | Wisniewski et al. | 62/66 |
| 6,635,414 | B2 | 10/2003 | Wisniewski et al. | 435/1.3 |
| 6,684,646 | B2 * | 2/2004 | Voute et al. | 62/66 |
| 6,698,213 | B2 | 3/2004 | Voute et al. | 62/66 |
| 6,773,081 | B2 | 8/2004 | Yuyama et al. | |
| 6,945,056 | B2 | 9/2005 | Brown et al. | 62/66 |
| 7,104,074 | B2 | 9/2006 | Voute et al. | 62/62 |
| 7,137,261 | B2 | 11/2006 | Brown et al. | 62/66 |
| 2003/0080126 | A1 | 5/2003 | Voute | |
| 2007/0240432 | A1 * | 10/2007 | Voute et al. | 62/66 |

FOREIGN PATENT DOCUMENTS

| | | | |
|---|---|---|---|
| DE | 3833753 | A1 | 8/1989 |
| DE | 4029216 | | 3/1992 |
| EP | 0318924 | | 6/1989 |
| EP | 0726080 | A2 | 12/1995 |
| EP | 1 134 000 | A2 | 9/2001 |
| FR | 758510 | | 1/1934 |
| FR | 2501057 | | 10/1982 |
| GB | 2 196 830 | A | 5/1988 |
| GB | 2240165 | A | 7/1991 |
| GB | 2351799 | A | 1/2001 |
| WO | EP 0195919 | A2 | 2/1986 |
| WO | EP 0647707 | A2 | 7/1994 |
| WO | WO 97/18424 | | 5/1997 |
| WO | WO 97/24152 | | 7/1997 |
| WO | WO 98/23907 | | 6/1998 |
| WO | WO 98/34078 | | 8/1998 |
| WO | WO 00/72902 | | 12/2000 |
| WO | WO 03/037082 | A | 5/2003 |

OTHER PUBLICATIONS

Burton et al., "An Experimental Investigation of the Solidification Process in a V-Shaped Sump", Inter. J. Heat Mass Transfer, vol. 18, pp. 2383-2393, 1995.

Kalhori, B. et al., "Studies on Heat Transfer From a Vertical Cylinder, With or Without Fins, Embedded in a Solid Phse Change Mediam", Transactions of the ASME, Journal of Heat Transfer, vol. 107, Feb. 1985, pp. 44-51.

Quan et al., "Effects of Vibration on Ice Contact Melting Within

Rectangular Enclosures", Transactions of the ASME 120:518-520 (May 1998).
Stahl, A.L., "Concentration of Citrus Juices by Freezing", Florida State Horticultural Society, 1944, pp. 43-45.
Wisniewski et al., Large-Scale Freezing and Thawing of Biopharmaceutical Drug Product, PharmTech Conference, Sep. 16-19, 1996, Sheraton Meadowlands, East Rutherford, New Jersey.
Wisniewski, Bioprocessing, Controlled Freeze/Thaw for Biopharmaceuticals, Tutorial: Preservation of Bioproducts Using Controlled Freeze/Thaw Operations, Genetic Engineering News, Feb. 15, 2003, vol. 32, No. 4, pp. 36 & 38.
Wisniewski, et al., "Large-Scale Freezing and Thawing of Biopharmaceutical Drug Product", Proceedings of the International Congress: Advanced Technologies for Manufacturing of Aseptic & Terminally Sterilized Pharmaceuticals & Biopharmaceuticals, Basel, Switzerland, Feb. 17-19, 1992, pp. 132-140.
Wisniewski, et al., "Large-Scale Freezing and Thawing of Biopharmaceutical Products", Biotechnology and Biopharmaceutical Manufacturing, Processing and Preservation, pp. 7-59.
Wisniewski, Richard, "Developing Large-Scale Cryopreservation Systems for Biopharmaceutical Products", BioPharm, Jun. 1998, pp. 50-60.
Wu, et al., "Scale-Down Approach to Large Volume Cryopreservation of Biopharmaceuticals Using the CryoCassette™ and CryoWedge™", Integrated Biosystems, 2000, 4 pages.
Double Contact PlateFreezers, Dole Plate Freezers, www.bmil.com/dole, copyright 1996, BMIL International.
Form PCT/ISA/220—Notification of Transmittal of the International Search Report and the Written Opinion of the Searching Authority, or the Declaration- dated Jan. 28, 2009, for corresponding International Application No. PCT/US2007/063381, filed Mar. 6, 2007.
Form PCT/ISA/210—International Search Report, dated Jan. 21, 2009, for corresponding International Application No. PCT/US2007/063381, filed Mar. 6, 2007.
Form PCT/ISA/237—Written Opinion of the International Searching Authority—dated Jan. 21, 2009, for corresponding International Application No. PCT/US2007/063381, filed Mar. 6, 2007.

* cited by examiner

FIG. 11
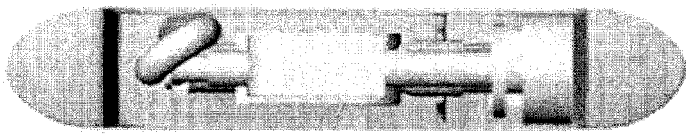
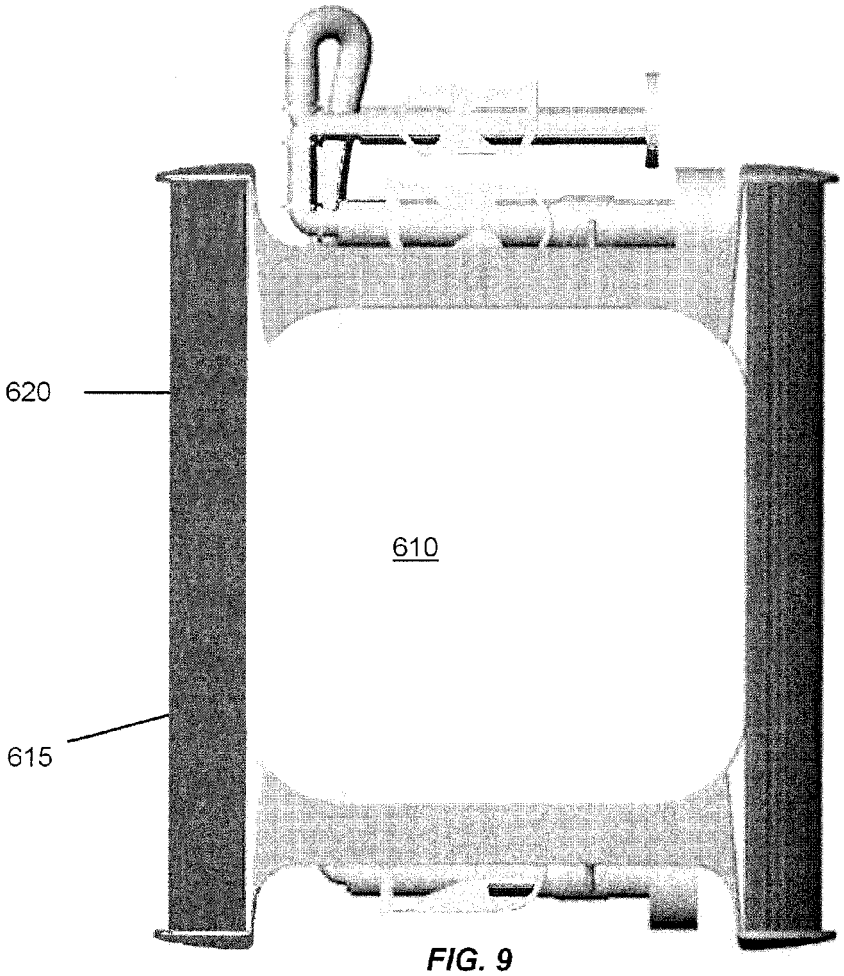
FIG. 9
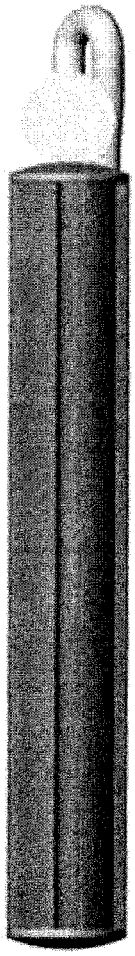
FIG. 10

FIG. 16
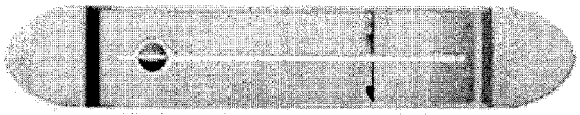
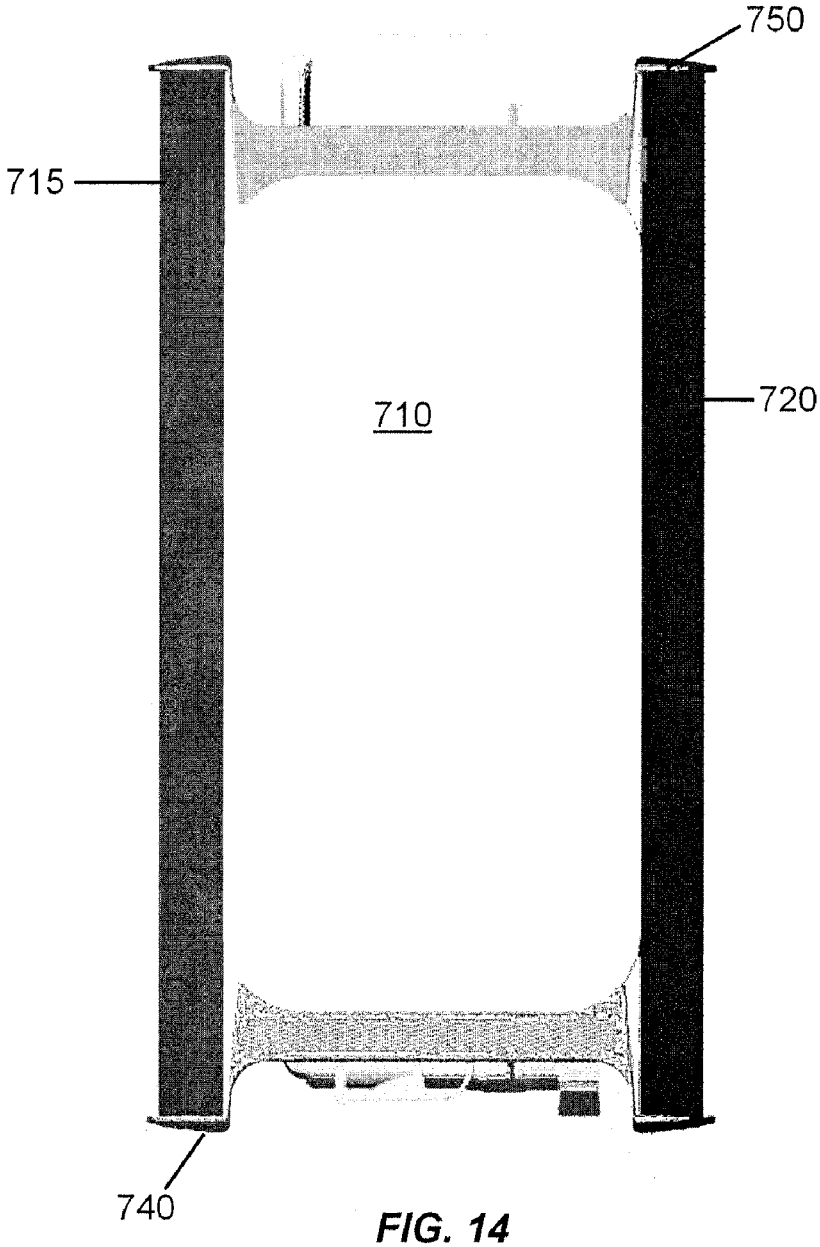
FIG. 14
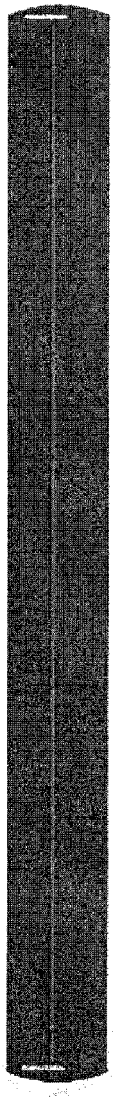
FIG. 15

SYSTEMS AND METHODS FOR FREEZING, STORING AND THAWING BIOPHARMACEUTICAL MATERIALS

CROSS-REFERENCE TO RELATED APPLICATIONS

This application claims the benefit of U.S. Provisional Patent Application No. 60/779,823, filed on Mar. 6, 2006, the entirety of which is incorporated herein by reference.

TECHNICAL FIELD

This invention relates, in general, to biopharmaceutical materials, preservation methods and systems, and more particularly to systems and methods for freezing, mixing, storing and thawing of biopharmaceutical materials.

BACKGROUND ART

Preservation of biopharmaceutical materials, such as cryopreservation, is important in the manufacture, use, transport, storage and sale of such materials. For example, biopharmaceutical materials are often preserved by freezing between processing steps and during storage. Similarly, biopharmaceutical materials are often frozen and thawed as part of the development process to enhance the quality or to simplify the development process.

When freezing biopharmaceutical materials, the overall quality, and in particular pharmaceutical activity, of the biopharmaceutical materials is desirably preserved, without substantial degradation of the biopharmaceutical materials.

Currently, preservation of biopharmaceutical material, particularly in bulk quantities, often involves placing a container containing liquid biopharmaceutical material in a cabinet freezer, chest freezer or walk-in freezer and allowing the biopharmaceutical material to freeze. Specifically, the container, which is typically one or more liters in volume and may range up to ten or more liters, is often placed on a shelf in the cabinet freezer, chest freezer or walk-in freezer and the biopharmaceutical material is allowed to freeze. These containers may be stainless-steel vessels, plastic bottles or carboys, or plastic bags. They are typically filled with a specified volume to allow for freezing and expansion and then transferred into the freezers at temperatures typically ranging from negative 20 degrees Celsius to negative 70 degrees Celsius or below.

To ensure efficient use of available space inside the freezer, containers are placed alongside one another and sometimes are stacked into an array with varied spatial regularity. Under these conditions, cooling of the biopharmaceutical solution occurs at different rates depending on the exposure of each container to the surrounding cold air, and the extent to which that container is shielded by neighboring containers. For example, containers placed close to the cooling source or those on the outside of an array of containers would be cooled more rapidly than those further away from the cooling source and/or situated at the interior of the array.

In general, adjacent placement of multiple containers in a freezer creates thermal gradients from container to container. The freezing rate and product quality then depend on the actual freezer load, space between the containers, container size, container shape, and air movement in the freezer. This results in a different thermal history for the contents of the containers depending on their location in a freezer, and their size, for example. Also, the use of different containers for individual portions of a single batch of biopharmaceutical material may cause different results for portions of the same batch due to different thermal histories resulting from freezing in a multiple container freezer, particularly if the storage arrangement, and/or the size and shape of the containers, is haphazard and random. Another consequence of obtaining a range of freezing times is that the contents of certain containers may freeze so slowly that the target solute can no longer be captured within the ice phase, but remains in a progressively smaller liquid phase. This phenomenon is referred to as cyroconcentration. In some cases such cyroconcentration could result in precipitation of the biopharmaceutical product, thus resulting in product loss.

Disposable bulk storage containers such as plastic bags or other flexible containers often are damaged, leading to loss of the biopharmaceutical material. Particularly, the volumetric expansion of the biopharmaceutical materials during freezing could generate excessive pressure in an over filled bag or in a pocket of occluded liquid adjoining the bag material, possibly leading to rupture or damage to the integrity of the bag. Moreover, handling of such disposable containers, such as plastic bags, during freezing, thawing, or transportation of these containers often result in damage thereof, due, for example, to shock, abrasion, impact, or other mishandling events arising from operator errors or inadequate protection of the bags in use.

Similarly, thawing of bulk biopharmaceutical materials typically involved removing them from a freezer and allowing them to thaw at room temperature. Such uncontrolled thawing can also lead to product loss. Generally, rapid thawing of biopharmaceutical materials results in less product loss than slower thawing. Further, it may also be desirable to control temperature of the biopharmaceutical materials during a thawing process since exposure of some biopharmaceutical materials to elevated temperatures may also lead to product loss. For example, it may be desirable to maintain a thawing biopharmaceutical material at about 0° C. when still in liquid and solid form during thawing thereof.

Further, it may be desirable to mix liquid bulk biopharmaceutical material at a homogeneous temperature above, below, or at an ambient temperature level. The mixing of biopharmaceutical materials in containers is important in the manufacture, use, transport, and storage of such materials. For example, biopharmaceutical materials are often blended, compounded, or formulated by mixing during processing steps and kept homogeneous during storage. Similarly, biopharmaceutical materials are often blended, compounded, or formulated by mixing as part of this development process to enhance the quality or to simplify the development process.

Currently, in some aspects, mixing of bulk biopharmaceutical materials involves transferring the product out of a container comprising the biopharmaceutical materials into a tank with a mechanical agitator, mixing and transferring the material back to the container. During those operations the containment may be broken and the product sterility and purity compromised. The homogeneous product may separate again after transfer back to its original container. Multiple transfers may expose product to excessive shear and to gas-liquid interfaces, which may adversely affect the product. Thus, it is preferable if such mixing can be accomplished without transferring the biopharmaceutical material out of the container or inserting a mixer into the container, i.e., noninvasive mixing is preferred. When utilizing such noninvasive mixing, the overall quality, sterility, and in particular pharmaceutical activity, of the biopharmaceutical materials is desirably preserved, without substantial degradation of the biopharmaceutical materials.

Thus, there is a need for systems and methods for freezing, thawing, storing, and mixing biopharmaceutical materials, particularly in bulk quantities, that are controlled, do not result in loss of biopharmaceutical material, and are repeatable.

SUMMARY OF THE INVENTION

The present invention provides, in a first aspect, a system for use in freezing, storing and thawing biopharmaceutical materials which includes a flexible sterile container means for holding biopharmaceutical material therein and a holder more rigid than said container means. The container means is received in a cavity of the holder and the holder extends along a perimeter of the container means. The holder is fixedly connected to the container means. The holder includes opposing sides defining an opening and the container means extends between the opposing sides of the holder defining the opening. The container means includes a substantially smooth exterior surface extending between the opposing sides.

The present invention provides, in a second aspect, a method for use in freezing, storing and thawing biopharmaceutical materials which includes providing a flexible sterile container means for holding biopharmaceutical material therein. The holder is more rigid than the container means and is fixedly connected to the container means. The container means is received in a cavity of the holder and the holder extends along a perimeter of the container means. The container means extends between opposing sides of the holder defining an opening. The container means includes a substantially smooth exterior surface extending between the opposing sides.

BRIEF DESCRIPTION OF THE DRAWINGS

The subject matter which is regarded as the invention is particularly pointed out and distinctly claimed in the claims at the conclusion of the specification. The foregoing and other features, and advantages of the invention will be readily understood from the following detailed description of preferred embodiments taken in conjunction with the accompanying drawings in which:

FIG. 9 is a front elevational view of a second embodiment of a holder in accordance with the present invention;

FIG. 10 is a side elevational view of the holder of FIG. 9;

FIG. 11 is a top elevational view of the holder of FIG. 9;

FIG. 14 is a front elevational view of another embodiment of a holder in accordance with the present invention;

FIG. 15 is a side elevational view of the holder of FIG. 14;

FIG. 16 is top elevational view of the holder of FIG. 14;

DETAILED DESCRIPTION

In accordance with the principles of the present invention, systems and methods for freezing, thawing and storing biopharmaceutical materials are provided.

Figure 5:
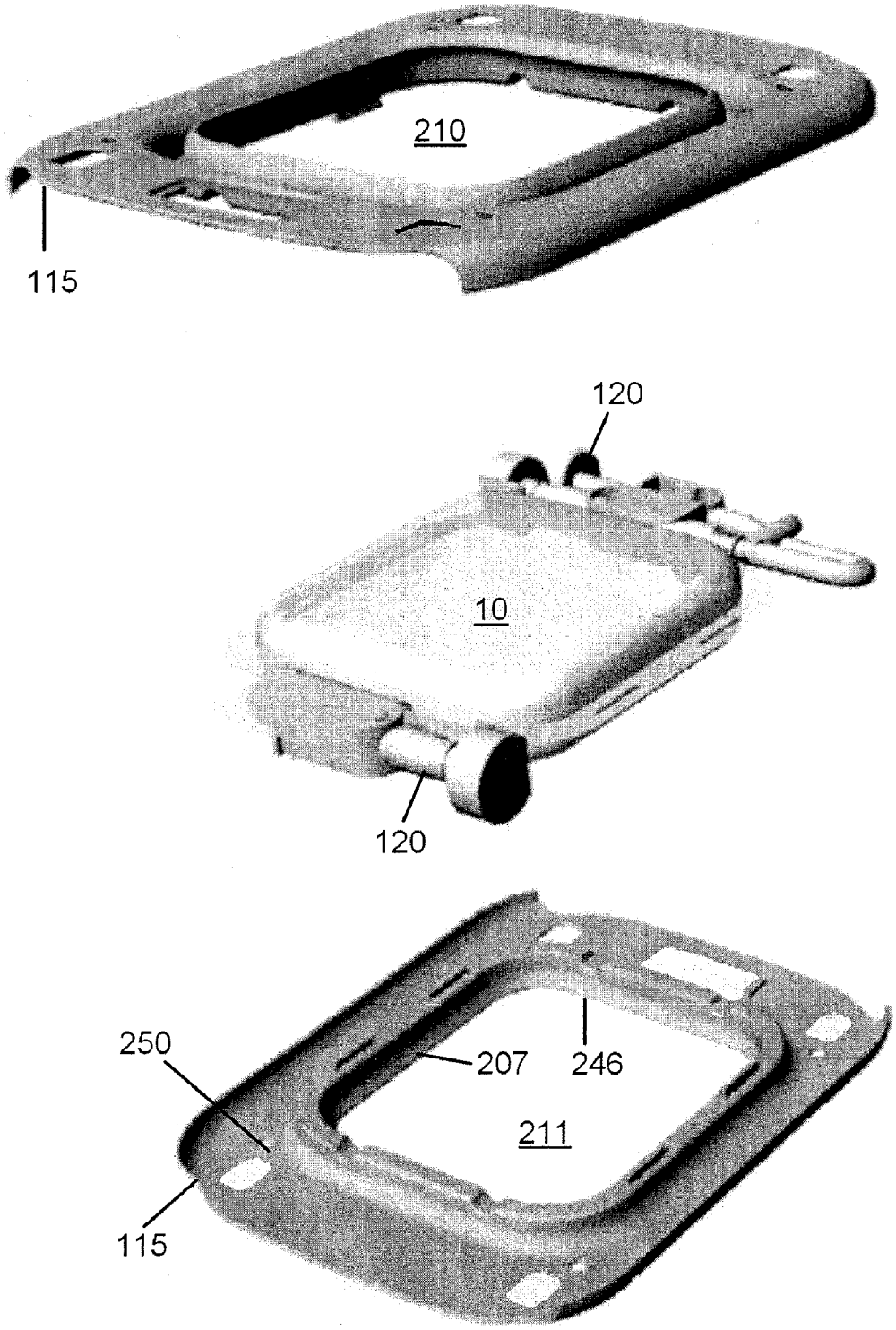
FIG. 5 is a perspective exploded view of the holder of FIG. 1.
Figure 6:
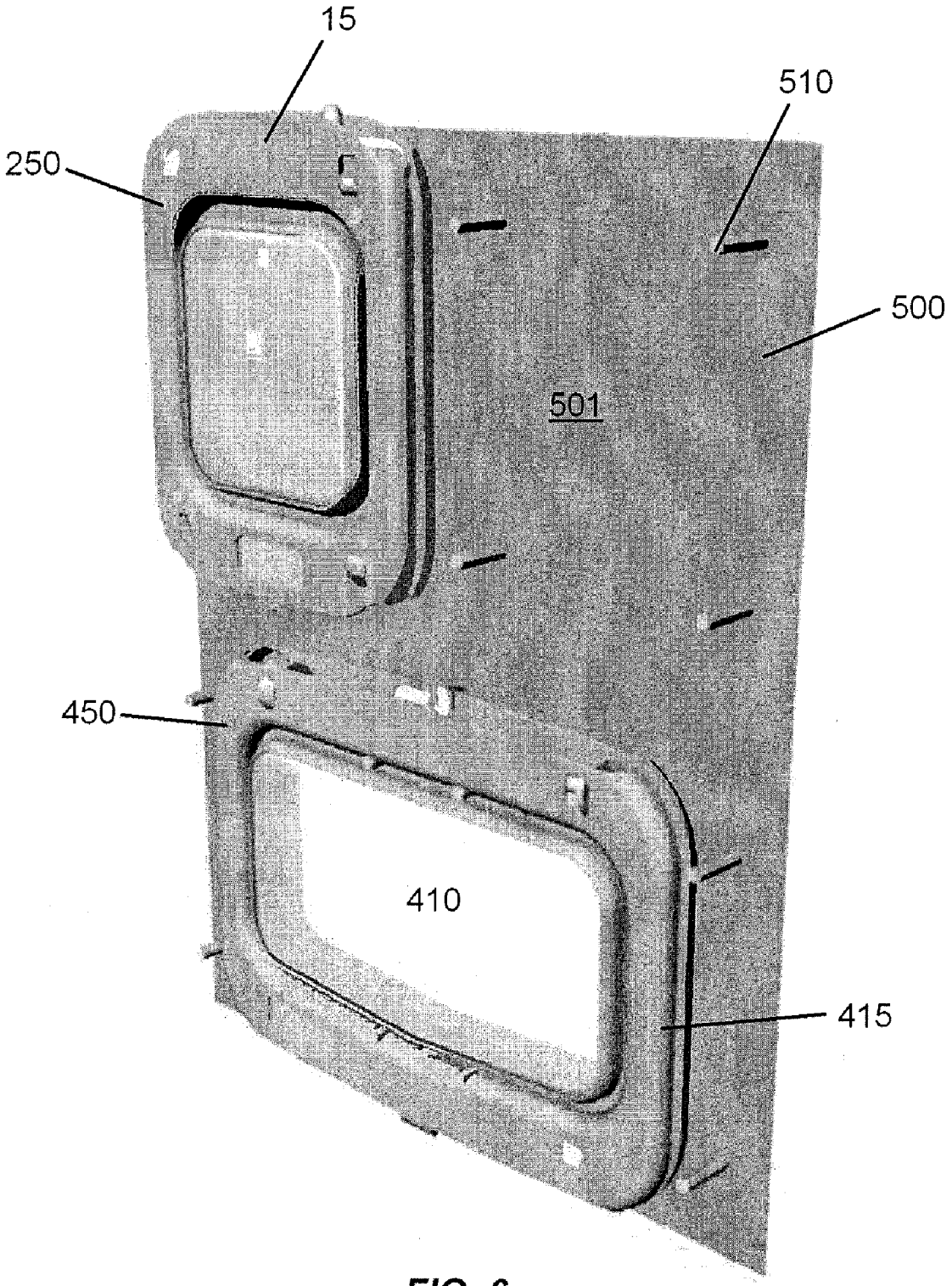
FIG. 6 is a perspective view of a supporting plate structure having the holder of FIG. 1 and a second holder attached thereto.
Figure 7:
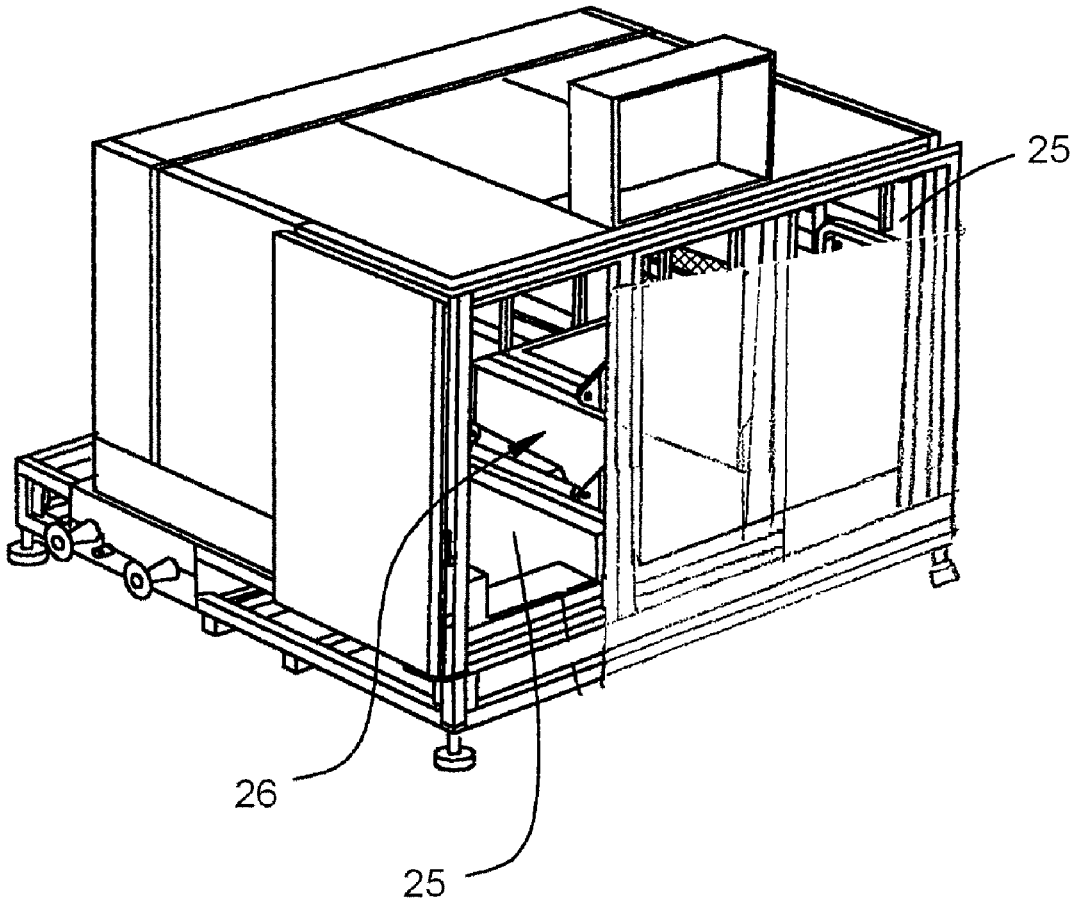
FIG. 7 is a perspective view of a temperature control unit.
Figure 8:
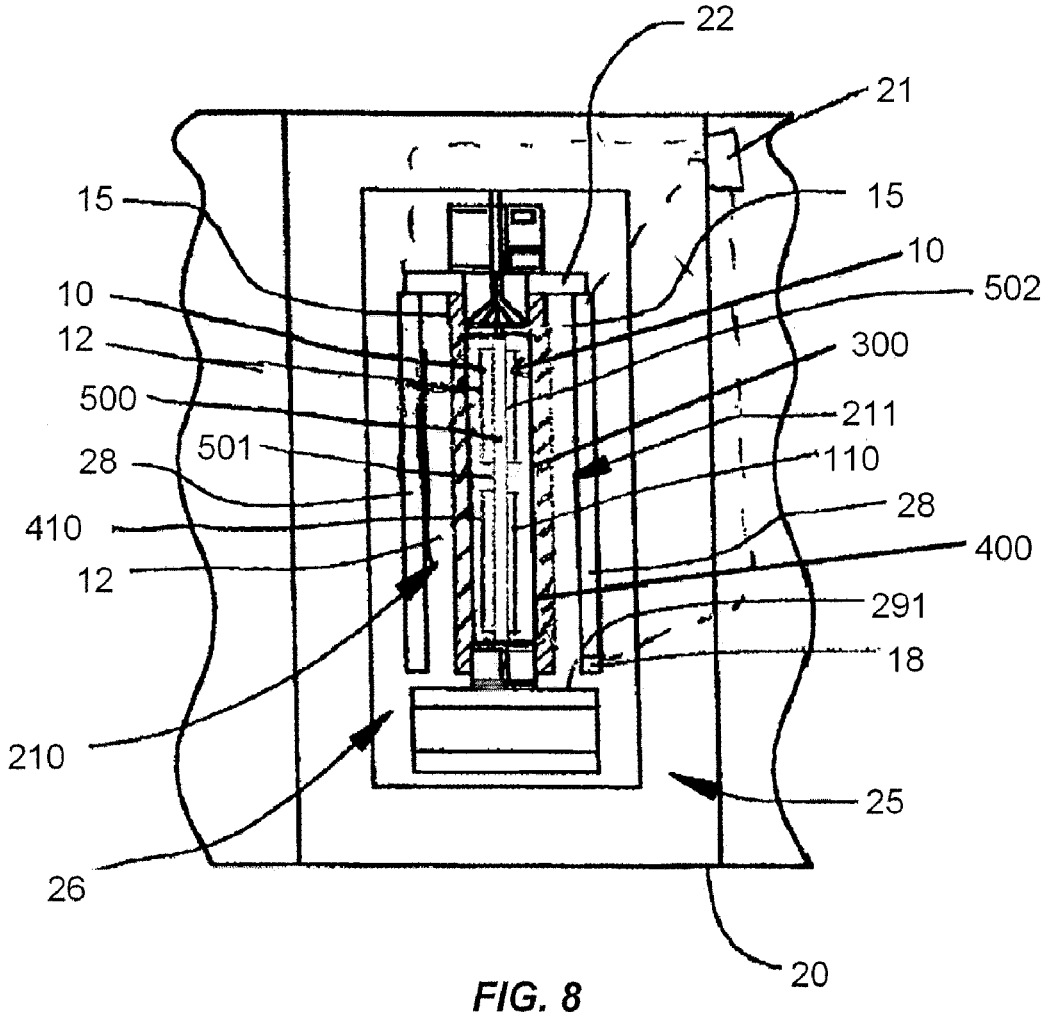
FIG. 8 is a cross-sectional view of an interior portion of the temperature control unit of FIG. 7 with the supporting plate structure of FIG. 6 having the holders of FIG. 1 attached thereto.

In an exemplary embodiment depicted in FIGS. 1-8 portions of a system for cooling, freezing, preserving, processing, thawing, and mixing biopharmaceutical materials are shown. The system may include a sterile container, such as a flexible container 10, configured to contain the biopharmaceutical materials and configured to be supported by a supporting structure, such as a frame or holder 15. The holder may be more rigid than the container and may include a cavity for receiving the container. The holder extends along a perimeter of the container and be fixedly connected to the containers. The holder includes opposing sides defining an opening. The container may extend between the opposing sides of the holder defining the opening and the container has a substantially smooth exterior surface extending between the opposing sides. Flexible container 10 and holder 15 may also be adapted to be received in a temperature control unit 20 (FIGS. 7-8).

Flexible container 10 (FIGS. 1-6 and 8) may be formed of a laminated film which includes a plurality of layers and may have an interior volume ranging from 0.01-100 liters, for example. Further, flexible container 10 could be available in a variety of sizes to accommodate different uses, for example, 1 and 2 liter flexible containers may be utilized. Such one and two liter containers are advantageous, because they may be transported by hand by an individual due to their moderate weight and bulk when filled with biopharmaceutical material. Also a biocompatible product-contacting layer of the interior of flexible container 10 may be formed of a low density polyethylene, very low density polyethylene, ethylene vinyl acetate copolymer, polyester, polyamide, polyvinylchloride, polypropylene, polyfluoroethylene, polyvinylidenefluoride, polyurethane or fluoroethylenepropylene, for example. A gas and water vapor barrier layer may also be formed of an ethylene/vinyl alcohol copolymer mixture within a polyamide or an ethylene vinyl acetate copolymer. Further, flexible container 10 may include a layer with high mechanical strength (e.g. a polyamide), and an external layer with insulating effect to heat welding, for example, polyester. The layers may be compatible with warm and cold conditions and may be able to withstand ionizing irradiation for sterilization purposes. Also, flexible container 10 may have a large surface area to volume ratio, and a relatively thin wall thus promoting heat transfer therethrough when received in temperature control unit 20 (FIGS. 7-8). One example of materials useful for formulation of flexible container 10 is described in U.S. Pat. No. 5,988,422 to Vallot, the entire subject matter of which is hereby incorporated herein by reference.

Container 10 may be adapted to receive and contain frozen and/or liquid biopharmaceutical materials. In an embodiment, the biopharmaceutical materials may comprise protein solutions, protein formulations, amino acid solutions, amino acid formulations, peptide solutions, peptide formulations, DNA solutions, DNA formulations, RNA solutions, RNA formulations, nucleic acid solutions, nucleic acid formulations, antibodies and their fragments, enzymes and their fragments, vaccines, viruses and their fragments, biological cell suspensions, biological cell fragment suspensions (including cell organelles, nuclei, inclusion bodies, membrane proteins, and/or membranes), tissue fragments suspensions, cell aggregates suspensions, biological tissues in solution, organs in solution, embryos in solution, cell growth media, serum, biologicals, blood products, preservation solutions, fermentation broths, and cell culture fluids with and without cells, mixtures of the above and biocatalysts and their fragments.

Sterile, flexible container 10 may be configured (e.g., shaped and dimensioned) to be received in, and integrally connected to, a supporting structure, such as frame or holder 15 (FIGS. 1-6), for supporting flexible container 10. For example, holder 15 may include a first portion 115 and a second portion 117 having a cavity 240 therebetween when fixedly connected to one another. Cavity 240 may be bounded by an inner surface 207, a first opening 210 and a second opening 211 on an opposite side of holder 15 from opening 210 as depicted in FIGS. 1-5. More specifically, container 10 may be received in cavity 240 and may be integrally (e.g., non-separably) connected to first portion 115 and/or second portion 117. For example, container 10 may be heat sealed (e.g., at one or more heat seal locations 242) or otherwise connected to first portion 115 and/or second portion 117 to prevent or inhibit separation of container 10 therefrom.

The openings (e.g., first opening 210 and second opening 211) in holder 15 may extend between opposite sides of a restraining flange or rim 246 of holder 15, which is configured to provide support to container 10 when it is filled with biopharmaceutical materials. More specifically, each opening may be surrounded by such a rim or other interior portion of a holder. Further, rim 246 may provide support in a direction such that it retains the container in the cavity (e.g., rim 246 may abut an exterior surface of container 10 and may inhibit movement of container 10 through opening 210 or opening 211 toward an exterior of holder 15). Also, rim 246 is shaped to retain and protect an outer perimeter of container 10, e.g., to inhibit or prevent sharp edges from contacting the container. Further, container 10 may extend substantially flat or smooth between opposite sides of rim 246. Also, the openings expose a large surface area of container 10 to an exterior of holder 15. For example, container 10 may be exposed to an interior 26 of a temperature control unit 20 (FIGS. 7-8) or a blast freezer (not shown), when received therein. A holder could include only one opening adjacent the container. For example, such a holder could include an opening, such as opening 210, while the opposite side (e.g., in place of opening 211) of the holder may be a solid portion formed of the same material as the rest of the holder.

Figure 2:
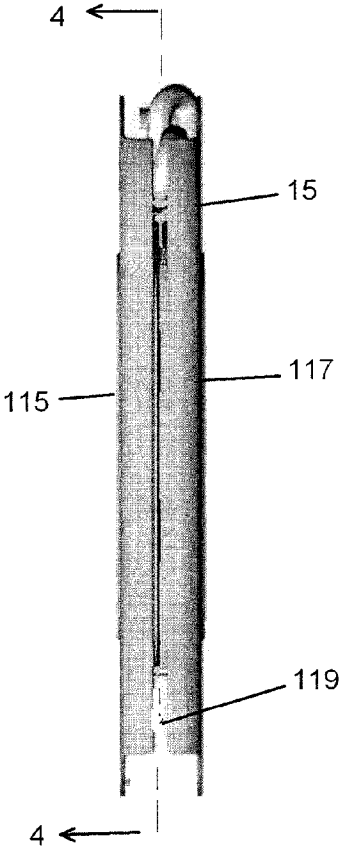
FIG. 2 is a side elevational view of the holder of FIG. 1.
Figure 1:
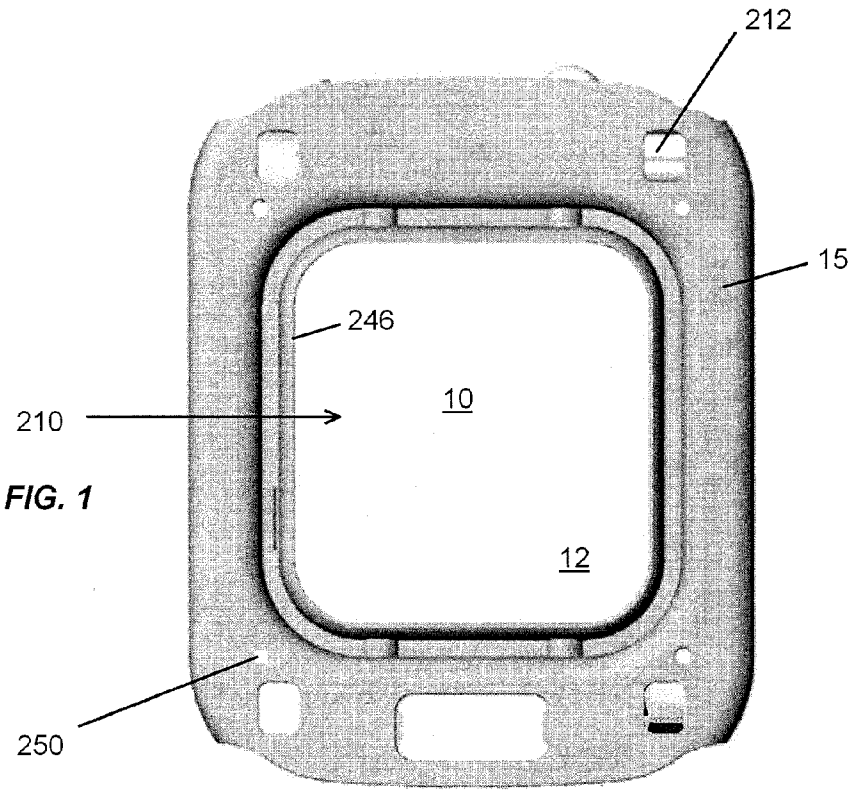
FIG. 1 is a front elevational view of a holder having a container therein in accordance with the present invention.
Figure 3:
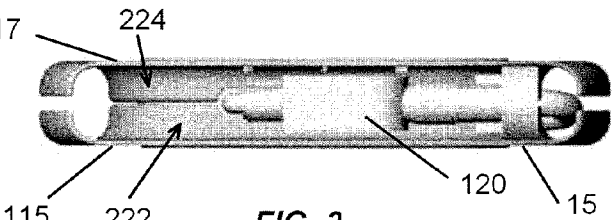
FIG. 3 is a top elevational view of the holder of FIG. 1.
Figure 4:
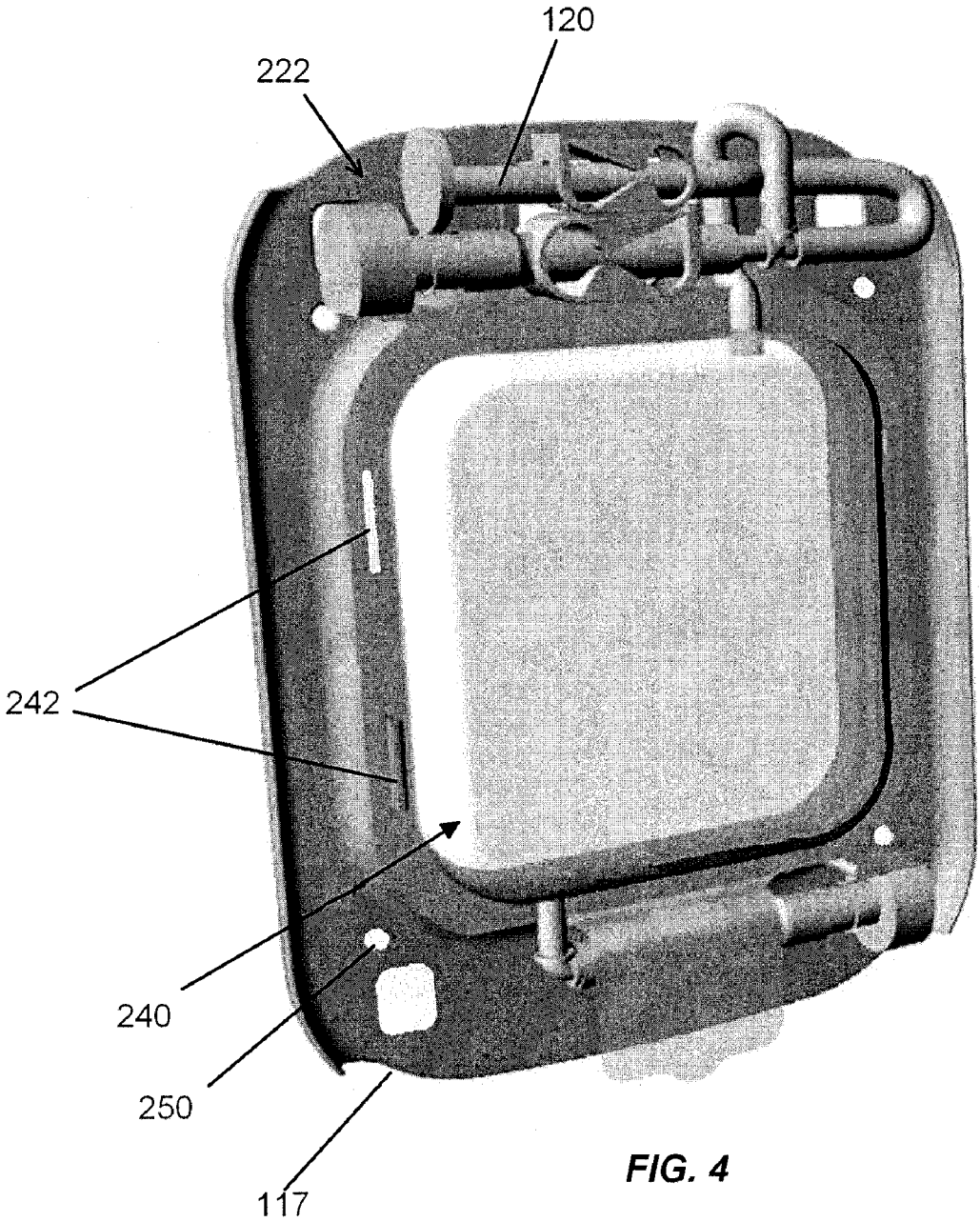
FIG. 4 is a cross-sectional view of the holder of FIG. 1 taken along lines 4-4 of FIG. 2.
Figure 19:
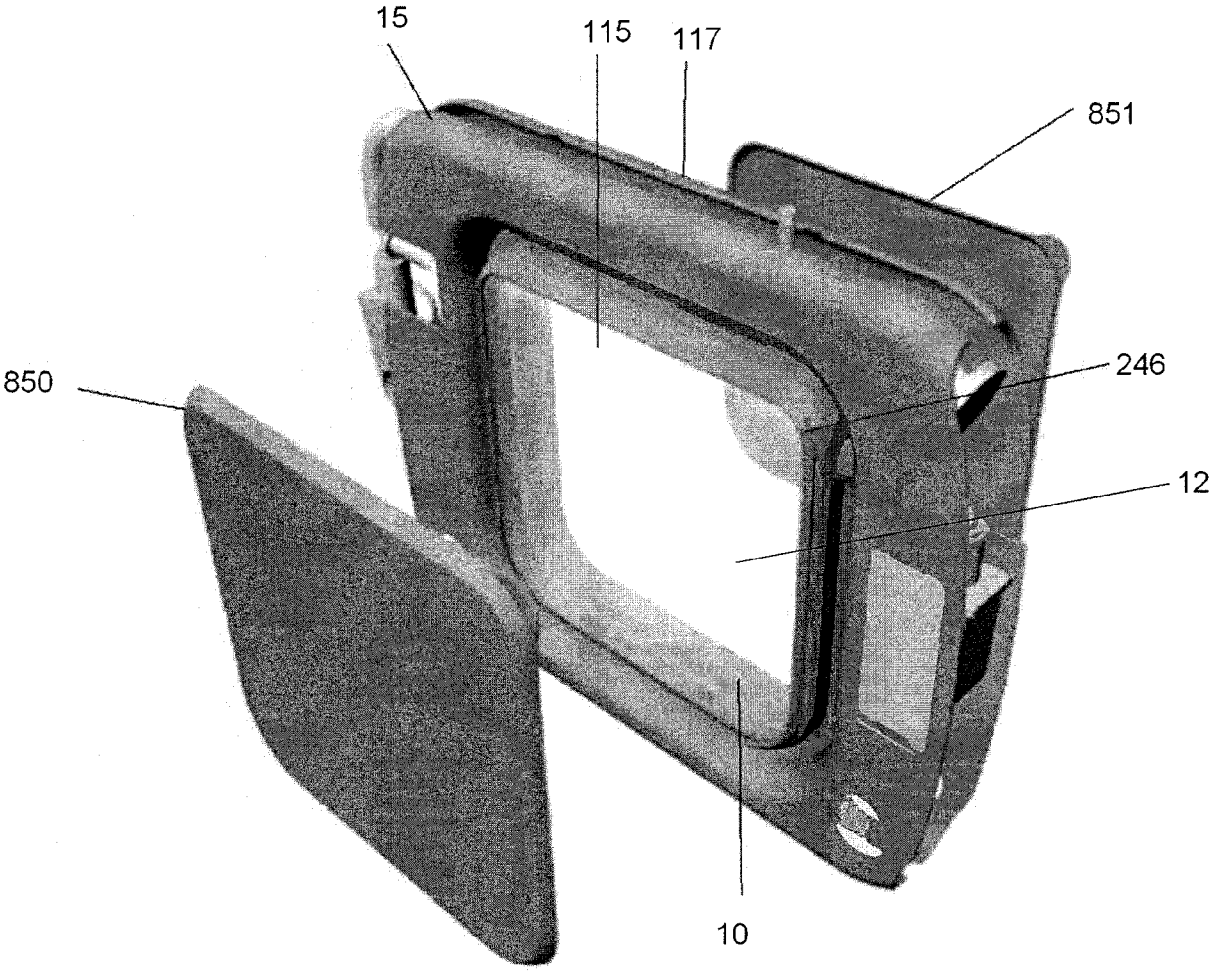
FIG. 19 is a top perspective view of the holder of FIG. 1 further including protective covers attachable to the holder.

As depicted in FIG. 2, first portion 115 and second portion 117 of holder 15 may be at least partially separated by a space 119 therebetween. Such space allows the deformation of first portion 115 and/or second portion 117 toward one another (i.e., into space 119) in response to an impact (such as the impact from a person dropping the holder 15 when the container 10 is filled with biopharmaceutical materials) or other stress placed thereon thereby avoiding such stress being applied to container 10. Any damage to container 10 resulting from such impact or stress is therefore reduced or inhibited. Damage may also be reduced or inhibited due to the perimeter of container 10 being surrounded by holder 15 connected thereto, which may be formed of molded plastic, stainless steel, or another material configured to support a weight of container 10 and protect container 10 from being punctured or damaged due to an impact or stress on holder 15. In addition, a container surface (e.g., a first side 12 of container 10) exposed to the exterior through openings 210 and 211 may be protected by additional covers 850 and 851 (FIG. 19) during the storage and or shipment of the holder 15. Such semi-rigid covers 850 and 851 may be releasably connected (e.g., snapped) onto rim 246 of the holder 15 following the freezing and/or thawing of the biopharmaceutical material in temperature control unit 20 of FIG. 8, or in a chest or walk in freezer. Also, the use of covers (e.g., covers 850 and 851) may allow multiple holders (e.g., holders 15) to be horizontally aligned and stacked on each other. For example, holder 15 having covers 850 and 851 attached thereto may be stacked with a second holder (e.g., holder 15) such that one of covers 850 and 851 may abut a cover on a the second holder (e.g., holder 15) located above or below holder 15 in a vertical stack of holders arranged horizontally. The covers may inhibit damage to containers held in the holders while providing structural support to the vertically stacked horizontally aligned holders.

As shown in FIGS. 2-5, container 10 may include one or more ports or conduits 120 to allow filling or draining of biopharmaceutical materials or other solids, liquids, or gases into and/or out of the interior (not shown) of container 10. Conduits 120 may also be used to insert a measurement probe (not shown) inside container 10 (e.g., a pH electrode, a conductivity sensor, temperature probe, an ion selective electrode, a spectophotometric probe, an ultrasound sensor, an optic fiber.) Conduits 120 may be received in a storage cavity 222 between first portion 115 and second portion 117 of holder 15. Cavity 222 may be positioned in the top part and/or the bottom part of container 10. The position of the conduits may facilitate filling and/or drainage of the containers. Storage cavity 222 may include an opening 224 to allow access to conduit 120. Further openings (e.g., a front storage opening 212) may also be located on the front side of protective case 15 to allow access to a label holder (not shown) attached to container 10 to facilitate the identification of the container.

Conduit 120 may be integral to container 10 or it may be connectable to a receiving port (not shown) thereof. For example, conduit 120 could be connected to a receiving port using a fitting placed within the inlet port. Fittings such as those described in U.S. Pat. No. 6,186,932, may be used for the connection of such conduits. Also, fittings which can maintain the sterility of the contents of the container or flexible container may preferably be used. The fittings may be configured in different shapes, such as straight fittings and/or angled fittings including ninety (90) degree elbows, if desired. In another example, conduit 120 may include a filter (not shown) to filter any impurities or other undesirable materials from the biopharmaceutical material. Storage cavity 222 may protect conduit 120 and the fittings from any damage resulting from impact or stress such as the impact resulting from a person dropping holder 15 when container 10 is filled with biopharmaceutical materials.

Holder 15 may preferably be formed of materials which remain stable and retain their structural properties over a large range of temperatures. Specifically, such materials should retain their load-bearing capacity and exhibit cold crack temperatures no higher than negative 80 degrees Celsius while being resistant to cleaning agents and methods commonly used in biopharmaceutical manufacturing, e.g., sodium hydroxide, sodium hypochloride (e.g., CLOROX), peracetic acid, etc. For example, holder 15 could be formed of injection molded plastic or thermo formed plastic. Also, holder 15 may be formed of fluoropolymer resin (e.g. TEFLON), stainless steel or any number of other materials including aluminum, polyethylene, polypropylene, polycarbonate, and polysulfone, for example. Further materials may include composite materials such as glass-reinforced plastic, carbon-fiber reinforced resins, or other engineering plastic materials known to offer high strength-to-weight rations and which are serviceable at various temperatures of interest. It will be understood by those skilled in the art that first portion 115 and second portion 117 may be monolithic and integrally formed as one piece or fixedly connected together. Further, holder 15 could be formed of a single material (e.g., injection molded plastic) or it could be formed of different materials and connected together. Also, such holders (e.g., holder 15) integrally connected to flexible containers (e.g., containers 10 and 410) may be disposable, thus promoting ease of use.

Also, a holder (e.g., holder 15) may be formed, sized and/or dimensioned to receive and support containers of various sizes to provide additional rigidity and support to the container(s), thus facilitating handling, storage, and/or temperature control thereof. For example, as depicted in FIG. 6, a second holder 415 may have a second container 410 received therein having a volume about twice that of container 10 held in holder 15. Holder 15 and holder 415 may be connected to a first side 501 of supporting plate 500. For example, holder 15 may include openings 250 configured to receive posts 510 of plate 500. Holder 15 may thereby be attached to plate 500 by receiving one or more posts 510 in one or more openings 250. Similarly, holder 415 may thereby be attached to plate 500 below holder 15 by receiving one or more posts 510 in one or more openings 450. Plate 500 may be received in a temperature control unit, such as temperature control unit 20 (FIGS. 7-8) or a blast freezer (not shown). Further, plate 500 could include posts or other connecting members on an exterior surface (not shown) on an opposite side 502 (FIG. 8) relative to first surface 501 such that containers may be attached to both sides of plate 500.

Figure 24:
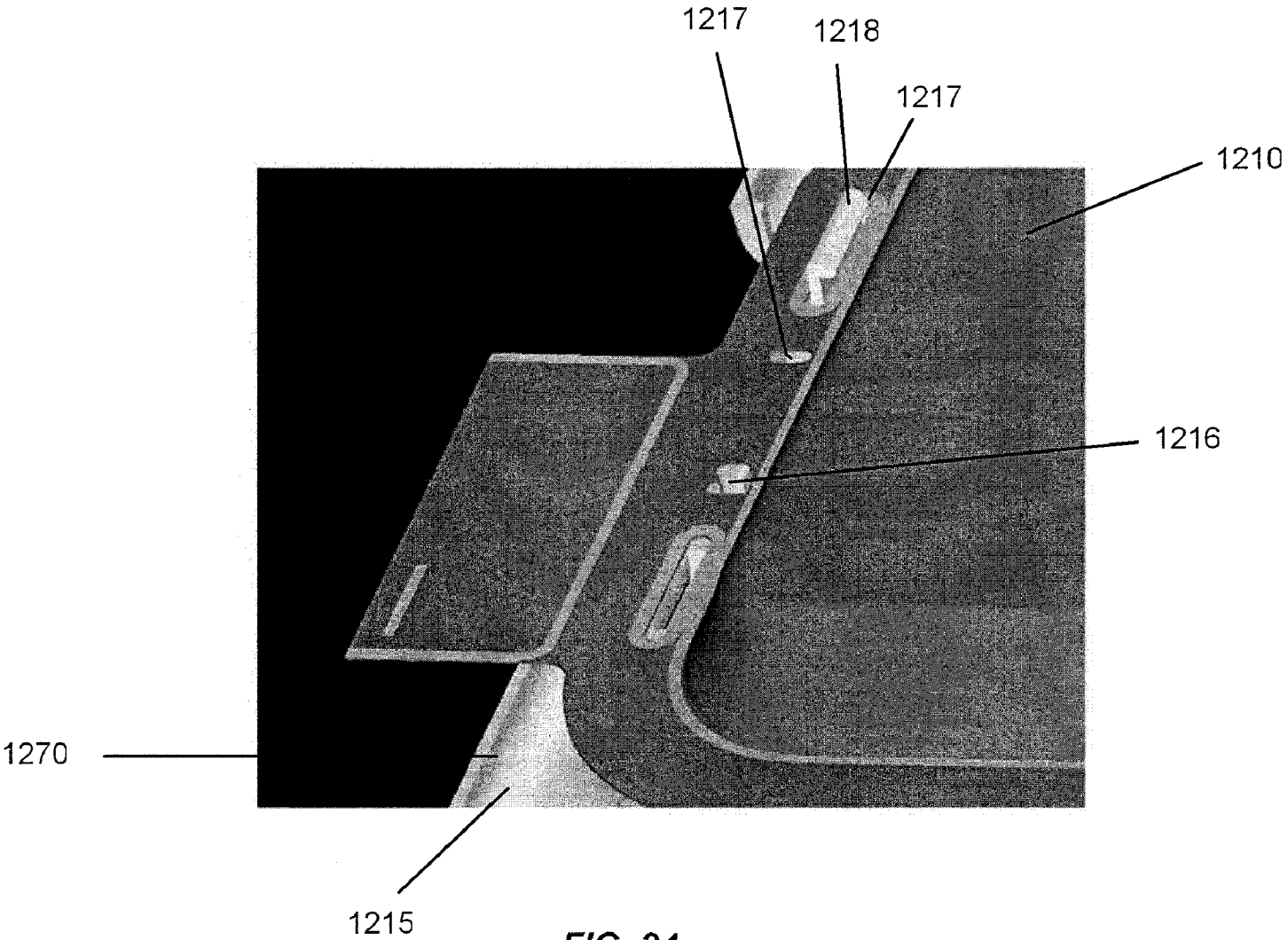
FIG. 24 is a top elevational view of a container having a slot engaged with a post and a snap of a holder in accordance with the present invention.

In another example depicted in FIG. 24, a container 1210 may be identical to container 10 except for the means of connection to a holder 1215. More particularly, container 1210 may have slots 1217 to receive snaps 1217 or posts 1216 of holder 1215. The posts or snaps may extend through the slots to connect a bottom portion 1270 of holder 1215 to a top portion (not shown) thereof. The connection between the bottom portion and top portion may be permanent or releasable.

Temperature control unit 20 is configured to control the temperature of cavity or interior 26 thereof, which may include one or more slots 25 as depicted in FIGS. 7 and 8. Also, temperature control unit 20 may include therein, or may be coupled to, a controller portion 21 and/or a sensor (e.g. a temperature sensor 18) to allow a user to control the heating, cooling, freezing, agitating, thawing, or mixing, for example, of the biopharmaceutical materials in flexible container 10, when containers 10 and 410 on supporting plate 500 are inserted into cavity 26 of temperature control unit 20. Heating, cooling, freezing or thawing of the contents of containers (e.g., container 10, container 410) placed inside temperature control unit 20 may be controlled by blowing a continuous stream of cold or warm air, by direct contact of the containers with cold or warm surfaces, or by spraying cooling fluid thereon (e.g., liquid nitrogen), for example.

In one embodiment, temperature control unit 20 includes a heat exchanger having one or more heat transfer or conduction plates for heating and/or cooling one or more containers and biopharmaceutical materials contained therein, as best depicted in FIGS. 7-8. For example, temperature control unit 20 may include heat transfer plates 28 for contacting the containers (e.g., container 10 and/or 410) to cool or heat the contents thereof. For example, first side 12 of container 10 may contact a heat transfer surface (e.g., one of plates 28) of interior 26 of temperature control unit 20 through opening 210 or opening 211 to control the temperature of the biopharmaceutical material in container 10. Alternatively, side 12 of flexible container 10 may be exposed to a still or circulating air within temperature control unit 20, a blast freezer or other means of controlling a temperature of an outer surface of a container (e.g., container 10) or immediate ambient surroundings thereof.

One or more of plates 28 could have heat transfer fluids circulating therethrough, such as water, oil, glycol, silicone fluid, hot air, cold air, alcohol, freons, freezing salty brines, liquid nitrogen or other heat transfer fluids as is known by those skilled in the art. Plates 28 could further include heat transfer enhancing structures such as fins and pins due to required high heat flux for product thawing, as will be understood by those skilled in the art.

One or more plates 28 may also include temperature sensor 18 mounted on an interior portion or exterior portion of plates 28 or it may be integral thereto. Temperature sensor 18 may detect a temperature of one or more of plates 28 and one or more locations thereon. Controller portion 21 of temperature control unit 20 may be coupled to temperature sensor 18 and to a heat transfer fluid control portion 22 of temperature control unit 20. Such heat transfer fluids may be circulated through plates 28 by heat transfer fluid control portion 22 controlled by controller portion 21 in response to temperatures detected by temperature sensor 18.

In another example, a temperature sensor (not shown) could be located in a heat transfer fluid input (not shown) of a plate and/or a heat transfer output (not shown) of such a plate. A difference between the temperatures determined at such points could be utilized to determine the temperature of the biopharmaceutical materials held in a container (e.g., containers 10 and 410). Thus, controller 21 may regulate a flow of heat transfer fluid to one or more of plates 28 to regulate a temperature of the biopharmaceutical materials held in such a container in slot 25 of cavity 26 of temperature control unit 20. More specifically, controller 21 may cause a heat transfer fluid control portion 22 to circulate heat transfer fluids in plate(s) 28 to raise or lower a temperature of plate(s) 28, thereby lowering or raising the temperature of a container (e.g., containers 10 and 410) which is in contact with plate 28. In this manner, the biopharmaceutical material may have its temperature controlled (i.e., it may be thawed or frozen).

Alternatively, such control of heat transfer plates 28 may be performed by controller portion 21 controlling flow of heat transfer fluid to plates 28 in a predetermined manner without feedback from a sensor coupled to plates 28 or the heat transfer fluid. In a further example, a temperature sensor (not shown) could extend through a port or conduit of a container (e.g., container 10) to allow a determination of a temperature of biopharmaceutical materials held therein. A flow of heat transfer fluid or other temperature regulation may be based on such determination.

Also, one or more of plates 28 may be moveable to contact container 10, container 410 and/or any other container when the containers are received in holders (e.g., holders 15 and 415) and the holders are connected to plate 500 and received in slot 25 of cavity 26 of temperature control unit 20, as depicted in FIG. 8. Further, plates 28 could be stationary and temperature control unit 20 may include one or more non-temperature controlled moveable plates, surfaces, or walls (not shown) configured to contact the container(s), when the container(s) and holder(s) are received in slot 25. Alternatively, plates 28 may be movable along with such additional movable plates, surfaces, or walls. For example, temperature control units useful with the containers (e.g., containers 10, 410, 610 and 710) and plates (e.g., plates 500 and 800) of the present application are disclosed in co-owned U.S. Pat. No. 6,945,056, entitled "Systems and Methods for Freezing, Mixing and Thawing Biopharmaceutical Material", granted on Sep. 20, 2005.

Figure 20:
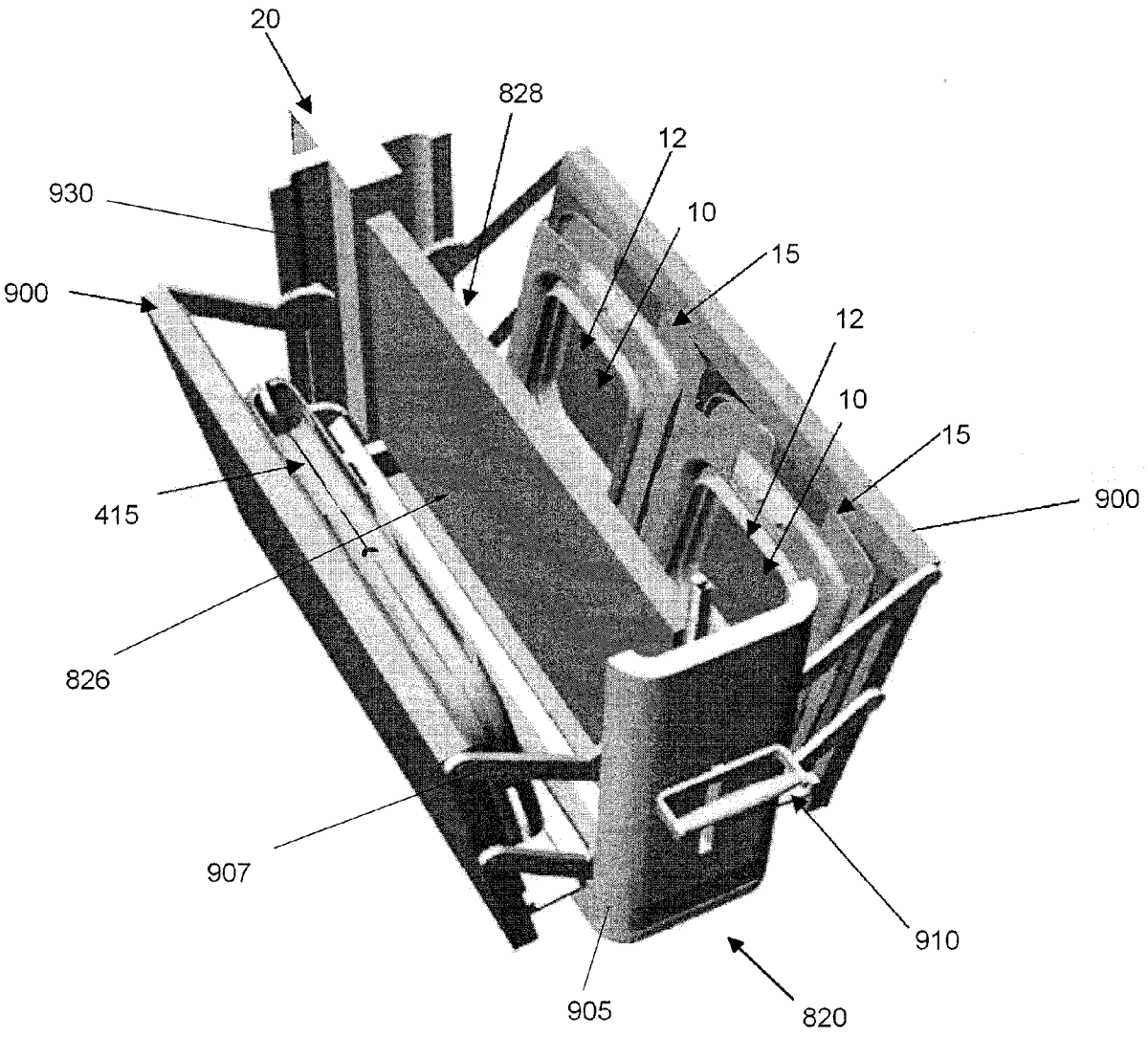
FIG. 20 is a top perspective view of another embodiment of a temperature control unit with multiple holders according to FIG. 1 placed inside it.

In another embodiment, a temperature control unit includes a heat exchanger having one or more stationary heat transfer surfaces, in which a heat transfer fluid is circulating, for heating, cooling, freezing and or thawing one or more containers and biopharmaceutical materials contained therein. For example, a temperature control unit 820 may include a stationary heat transfer plate 828 for contacting multiple containers (e.g. container 10 and/or 410) on one or on each face of heat transfer plate 828 as depicted in FIG. 20.

For example container 10 may be attached to a moveable door 900 of temperature control unit 820. Door 900 may be non-temperature controlled and/or insulated. Also, door 900 may be connected to a central body portion 905 of temperature control unit 820 by connecting rods or arms 907 which are pivotally connected to door 900 and central portion 905 to allow the moveable connection of door 900 between open (e.g., non-contacting position of the container relative to a heat exchange plate 828) and closed (e.g., contacting) positions. The movable door is configured to move to contact the container(s) with one face of heat exchange plate 828 during cooling and/or heating operations. For example, first side 12 of container 10 may contact a heat transfer surface (e.g., heat exchange plate 828) of an interior 826 of temperature control unit 820 through opening 210 to control the temperature of the biopharmaceutical material in container 10. The second (i.e., opposite) side of container 10 may contact the insulated moveable door 900 of the temperature control unit 20 via opening 211.

A latching mechanism 910 maintains the movable doors (e.g., doors 900) closed onto a sealing gasket 930 (FIG. 20) during the cooling and/or heating operations and insures a good thermal contact between heat exchange surface 28 and container first side 12, along with promoting a good insulation of interior 826 of the temperature control unit 820. A freezing path length defined by a distance between heat exchange plate 828 and movable door 900 when the doors are latched is substantially constant in any point of temperature control unit 820, which contributes to the uniformity of the thermal treatment of the biopharmaceutical material placed inside container 10.

Temperature sensors (not shown) may be mounted at an interface between moveable wall 900 and first side 12 of container 10 through opening 210. The temperature detected at this interface corresponds to the last point to freeze and last point to thaw location of the biopharmaceutical product stored in container 10. One or more of the temperature sensors may detect a temperature of one or more of containers 10 and one or more locations thereon. A controller portion (not shown) of temperature control unit 820 may be coupled to the temperature sensor(s) and to a heat transfer fluid control portion 822 (not shown) of temperature control unit 820. Such heat transfer fluids may be circulated through plate 826 by the heat transfer fluid control portion controlled by the controller portion in response to temperature(s) detected by the temperature sensor(s).

Also, a holder (e.g., holder 15 or 415) may include openings (not shown) configured to receive posts (not shown) of door 900. Holder 15 may thereby be attached to door 900 by receiving one or more posts in one or more openings. Similarly, holder 415 may thereby be attached to door 900 by receiving one or more posts in one or more openings. Although doors 900 are depicted as being connected to central body portion 905 each by four arms 907, the doors could be connected to the central body portion by more or less arms located at various locations along the doors and central body portion. For example, in addition to the exterior placement of the arms on the doors and interior connection thereof to the central body portion depicted, the arms could be connected to both exterior portions of the doors and a central body portion or both to interior portions thereof or a combination of these methods. The selective placement of the arms relative to the doors and the central body portion could allow the pivoting of the doors in various ways away from and back toward the central body portion. Further, the doors could be connected or latched to the central body portion in any number of ways having handles located on an exterior of the temperature control unit or hidden in some way. Moreover, the temperature control unit may be placed on a drip tray to catch any liquids such as biopharmaceutical materials, water, or other liquid coolants which may be produced by the freezing of biopharmaceutical materials, thawing of biopharmaceutical materials, condensation or other incidental leaks.

Figure 21:
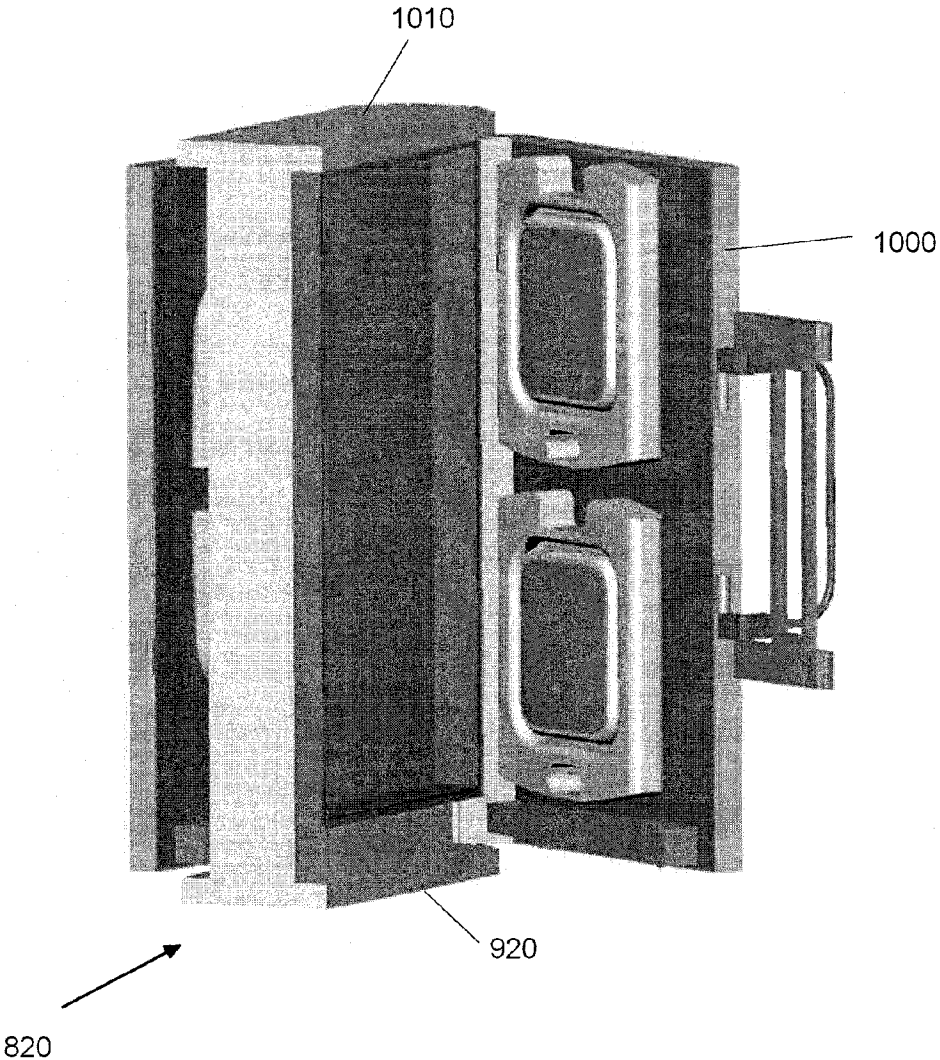
FIG. 21 is a perspective view of a further embodiment of a temperature control unit having multiple holders as depicted in FIG. 1 placed inside it.
Figure 22:
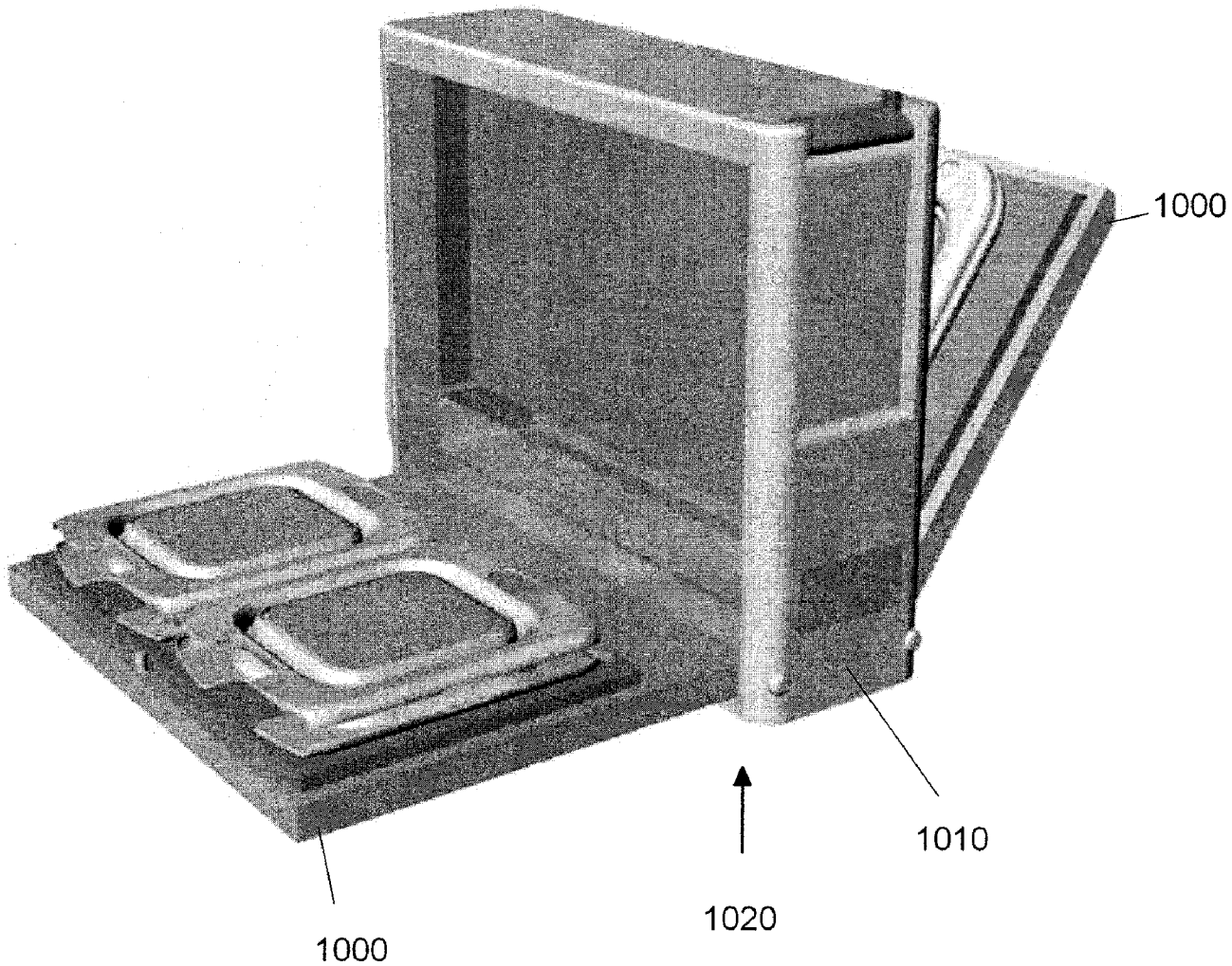
FIG. 22 is a perspective view of yet another embodiment of a temperature control unit having multiple holders as depicted in FIG. 1 received therein.
Figure 23:
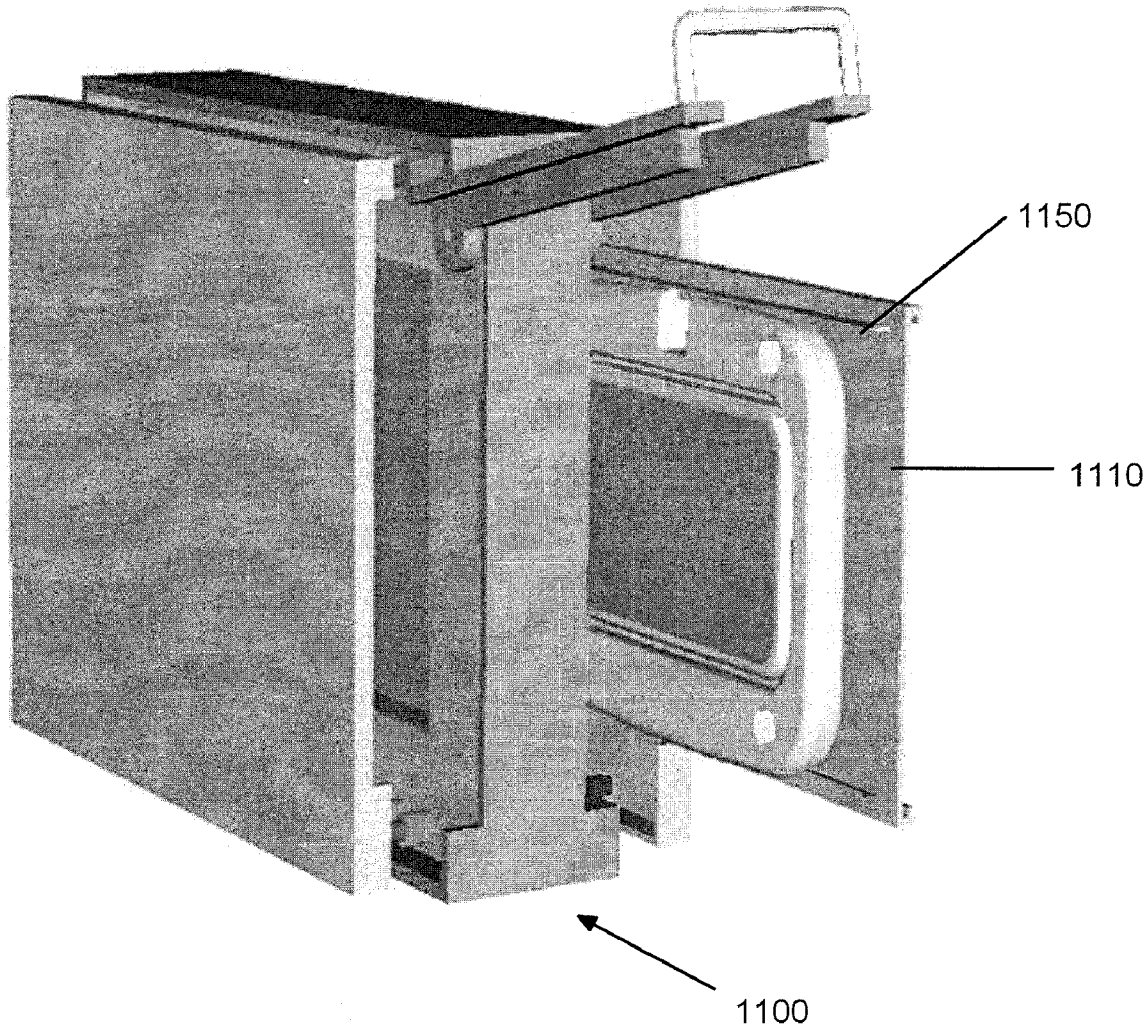
FIG. 23 is a perspective view of yet a further embodiment of a temperature control unit with multiple holders as depicted in FIG. 1 placed inside it.

FIGS. 21-22 depict a temperature control unit 1020 which is a variation of temperature control unit 820 differing in that doors 1000 are connected to a central portion 1010 at a bottom portion of door 1000 and central portion 1010 via a pin or hinge (not shown) instead of arms 907. In another example, holder 15 and/or holder 415 may be connected to an exterior surface of a plate 1100, that may be received inside a temperature control unit 1110, as depicted in FIG. 23. Plate 1110 may include posts or other connecting members such as rails 1150 configured (e.g., shaped and dimensioned) to engage a receiving slot (not shown) on an outer surface of holder 15.

Also, one or more moveable walls or doors (e.g., doors 900, 1000) may allow compression of a flexible container (e.g., flexible container 10), and hence good thermal contact and substantially constant container depth, when the container is received in a holder (e.g., holder 15) and the holder is received in an interior (e.g., interior 826) of a temperature control unit (e.g., temperature control units 820, 920, 1020, 1100). To compensate for the increased pressure and expansion resulting from the freezing of the biopharmaceutical aqueous solution stored inside the container, a moveable wall or door (e.g., doors 900, 1000) might be spring loaded to allow an increase of distance between a heat exchange plate (e.g., plate 828) and such a movable door (e.g., door 900).

Also, a temperature control unit (e.g., temperature control unit 20, 820, 920, 1100) may be mounted onto a reciprocating or orbital mixer (not shown), thereby allowing the agitation of, and thereby promote thawing and mixing of, biopharmaceutical materials held in a container (e.g., container 10) held therein. Such mixing could be performed for the purpose of thawing and mixing of the biopharmaceutical materials. More particularly, thawing rates of biopharmaceutical materials may be accelerated by generation of movement of partially-thawed solid-liquid mixture comprising a biopharmaceutical solution against walls of a container which may contact heat transfer surfaces, such as plates 28.

Figure 12:
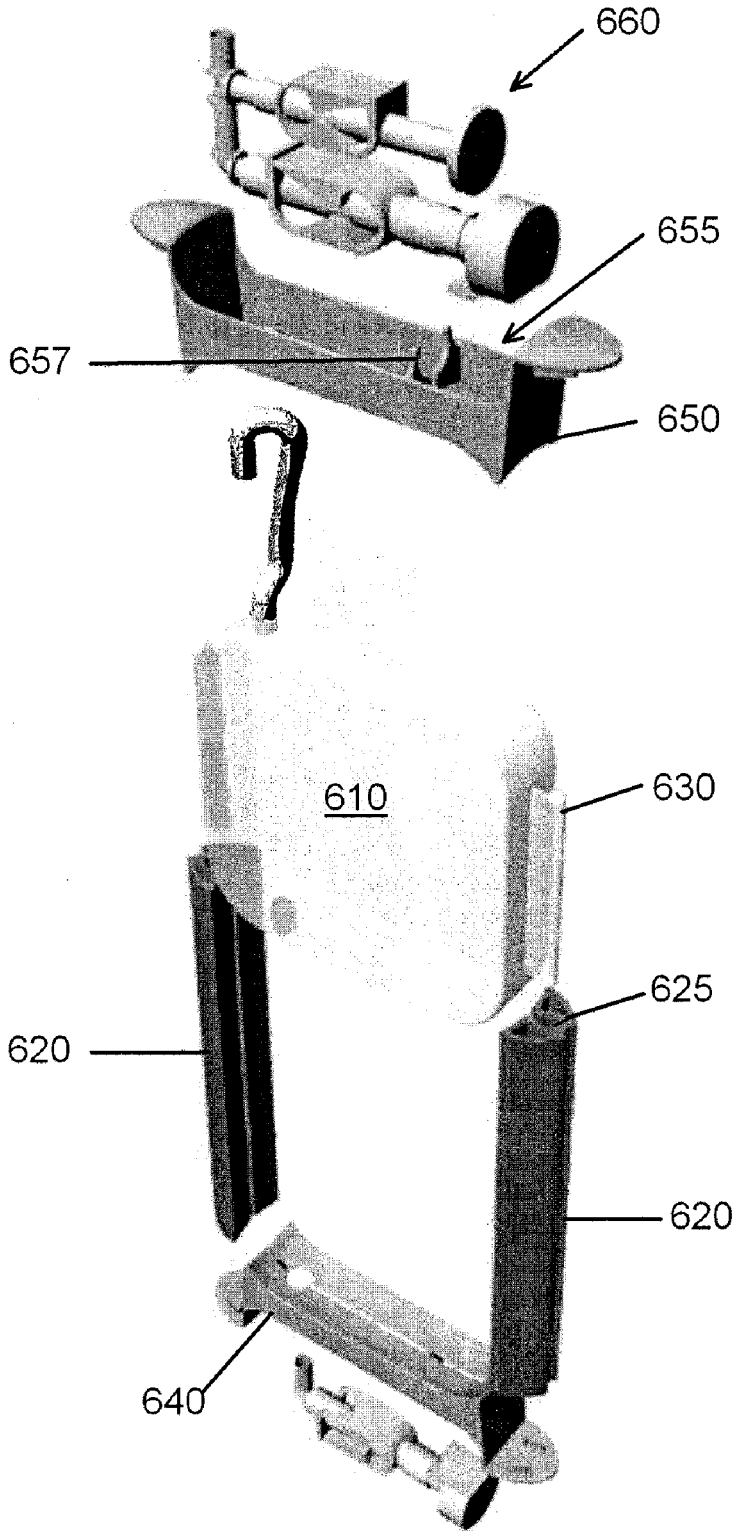
FIG. 12 is a perspective exploded view of the holder of FIG. 9.
Figure 13:
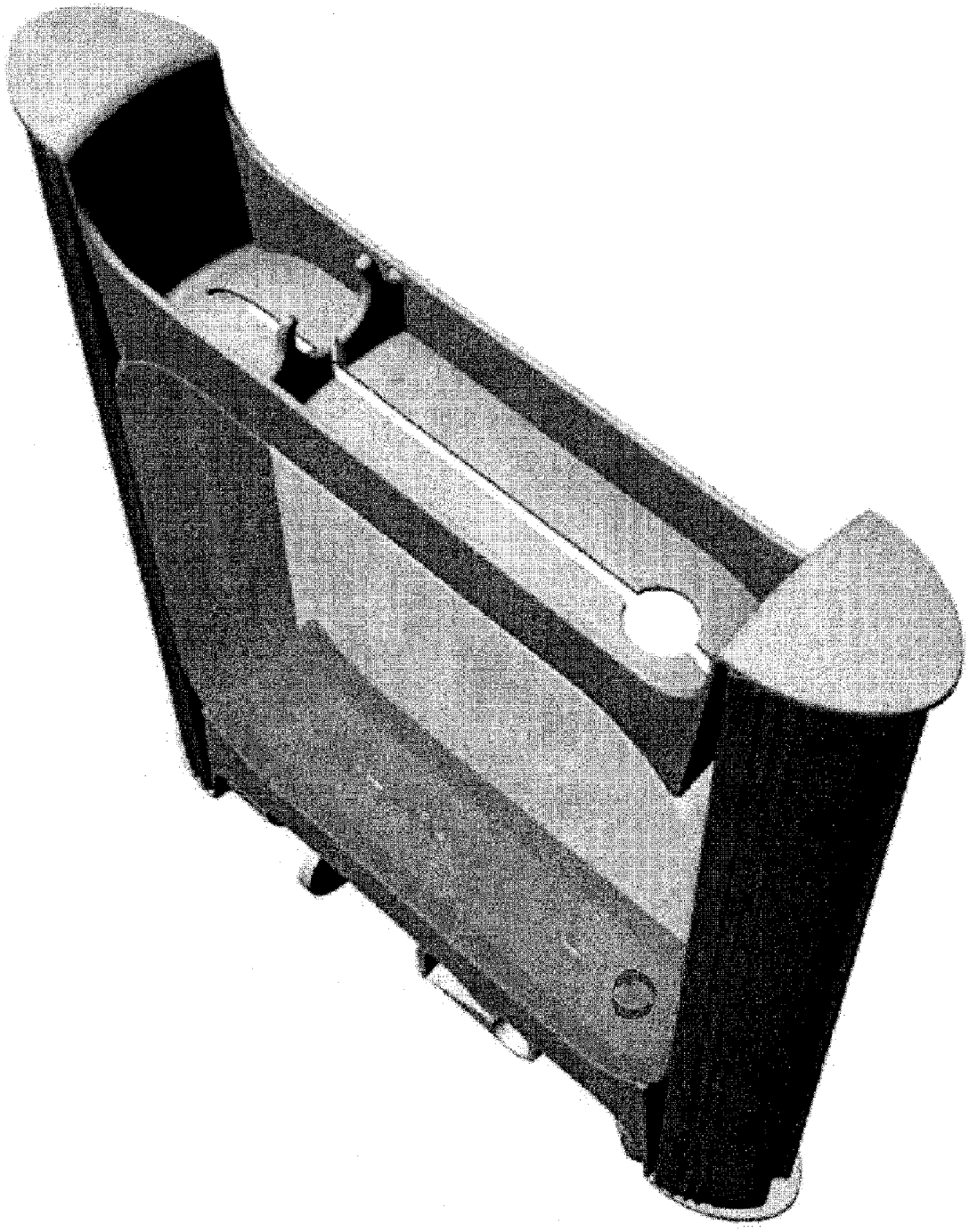
FIG. 13 is a top perspective view of the holder of FIG. 9.

In another embodiment depicted in FIGS. 9-13, a third holder 615 may be integrally connected to a third container 610. As depicted in FIG. 12, holder 615 may include two vertical uprights 620 having grooves 625 configured to receive flanges 630 of container 610. Holder 15 includes a upper cap 640 and lower cap 650, which may be identical or mirror images of one another, connected to uprights 620. Upper cap 640 and lower cap 650 may include cavities (e.g., cavity 655) to receive conduits and fittings, such as conduits 660, to allow filling, and/or draining, of container 610. Such cavities may also include connecting structures (e.g., flange 657) or other means for supporting the conduits. For example, flange 657 may be a semi-circular structure which receives one of conduits 660 to releasably connect conduits 660 thereto.

Figure 17:
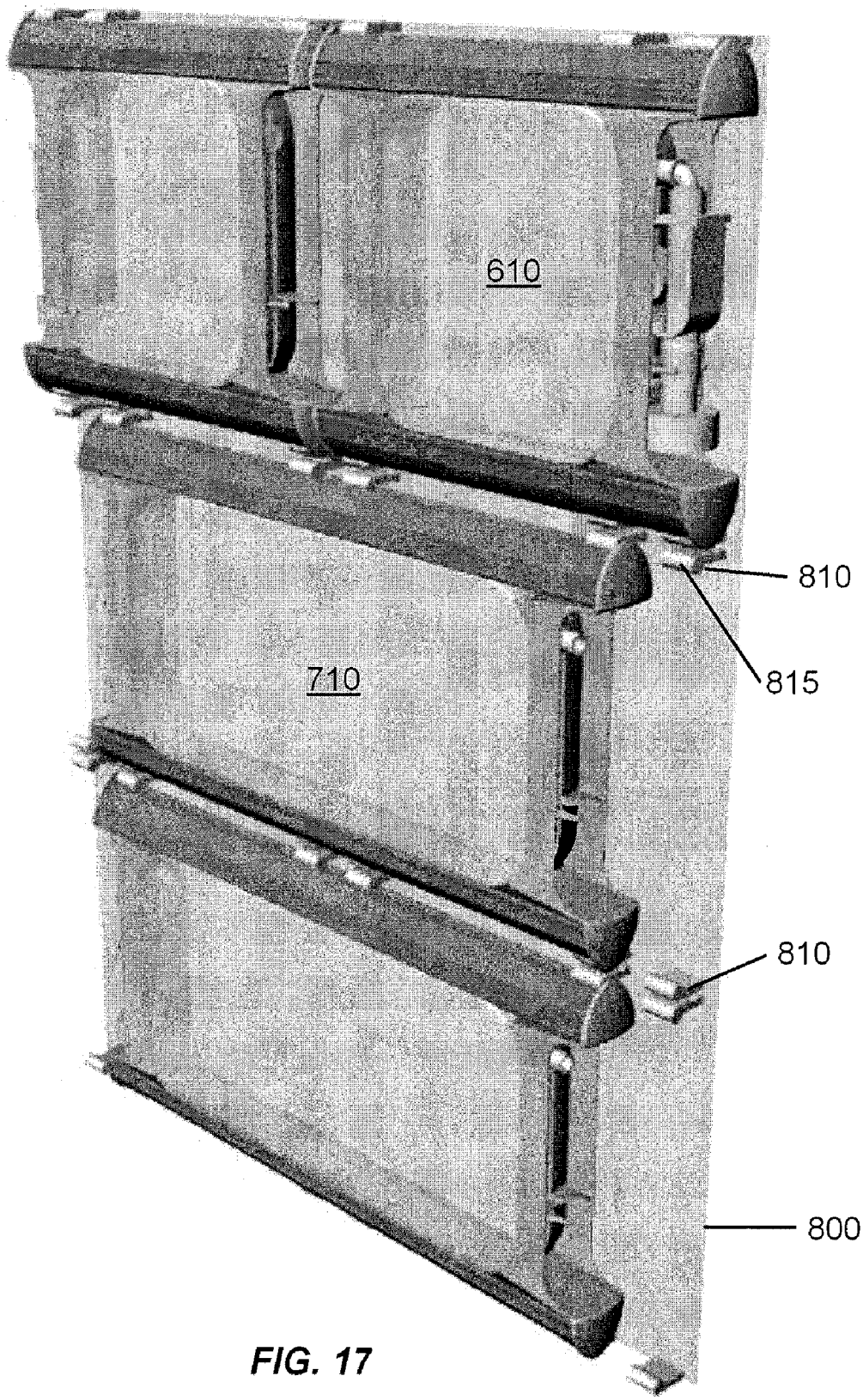
FIG. 17 is a perspective view of a supporting plate structure having the holder of FIG. 9 and the holder of FIG. 14 attached thereto.
Figure 18:
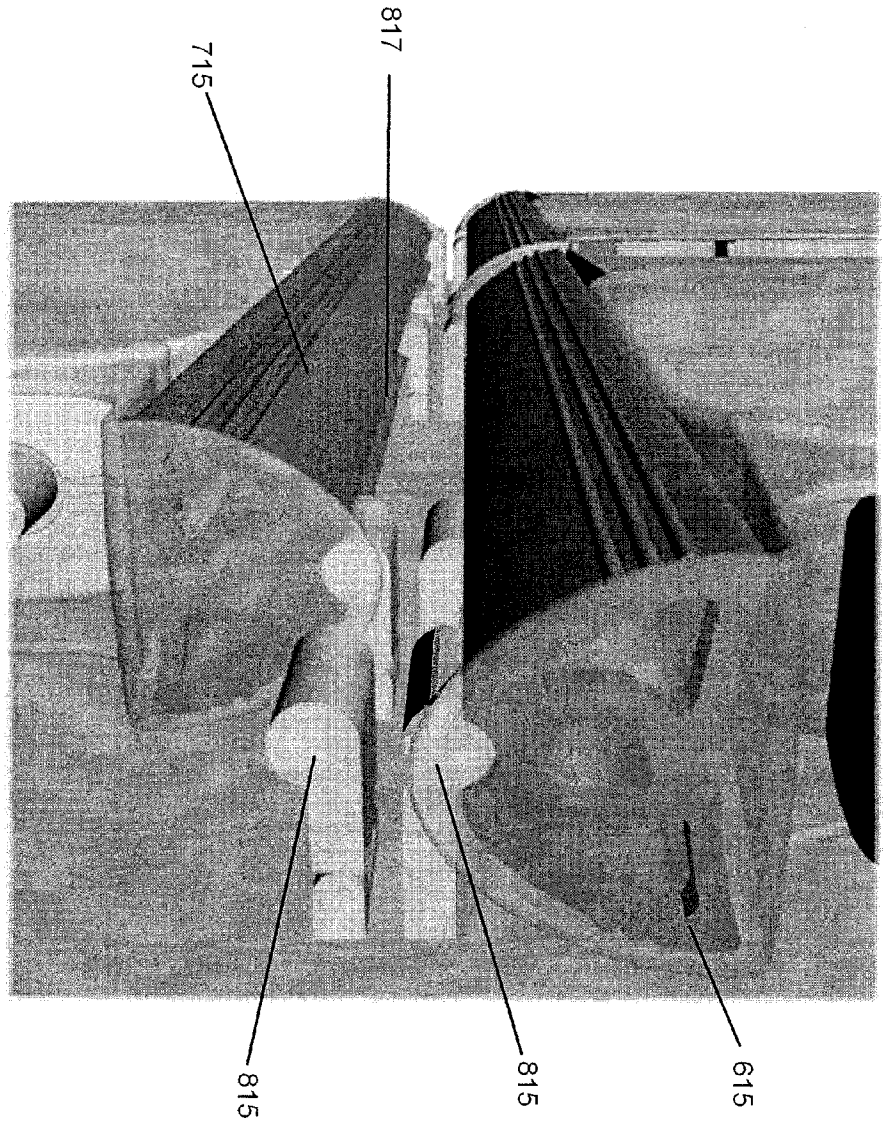
FIG. 18 is a perspective view of the holder of FIG. 9 attached to the supporting plate structure of FIG. 17 showing a connecting mechanism of the supporting plate structure being received in a groove of the holder.

As depicted in FIGS. 14-16, a fourth holder 715 may be integrally connected to a fourth container 710. Holder 715 may be constructed in the same manner (e.g., formed of a same material and having a substantially same cross-sectional area) as holder 615 except that uprights 720 may be taller than uprights 620 and container 710 may be taller than container 610. End caps 740 and 750 may be identical to caps 640 and 650. As depicted in FIG. 17, holder 615 and holder 715 may be releasably connected to a supporting plate 800. Clips 810 may be located on supporting plate 800 such that they are deformable above, below, and/or to a side of the container when it is attached to plate 800. Clips 810 may have a lip 815 on a front end thereof to attach to, and to retain, a holder (e.g., holder 615 and holder 715) on plate 800. Further, as depicted in FIGS. 17-18, such a holder (e.g., holder 615 and holder 715) may include a slot 817 for receiving lip 815 or another projecting portion of plate 800. As described above for holder 415 and holder 15 connected to plate 500, plate 800 may be received in a temperature control unit (e.g., temperature to unit 20) when holder 615 and/or holder 715 are connected thereto to facilitate cooling and/or heating of biopharmaceutical materials held in container 610 and/or container 710, for example.

Figure 25:
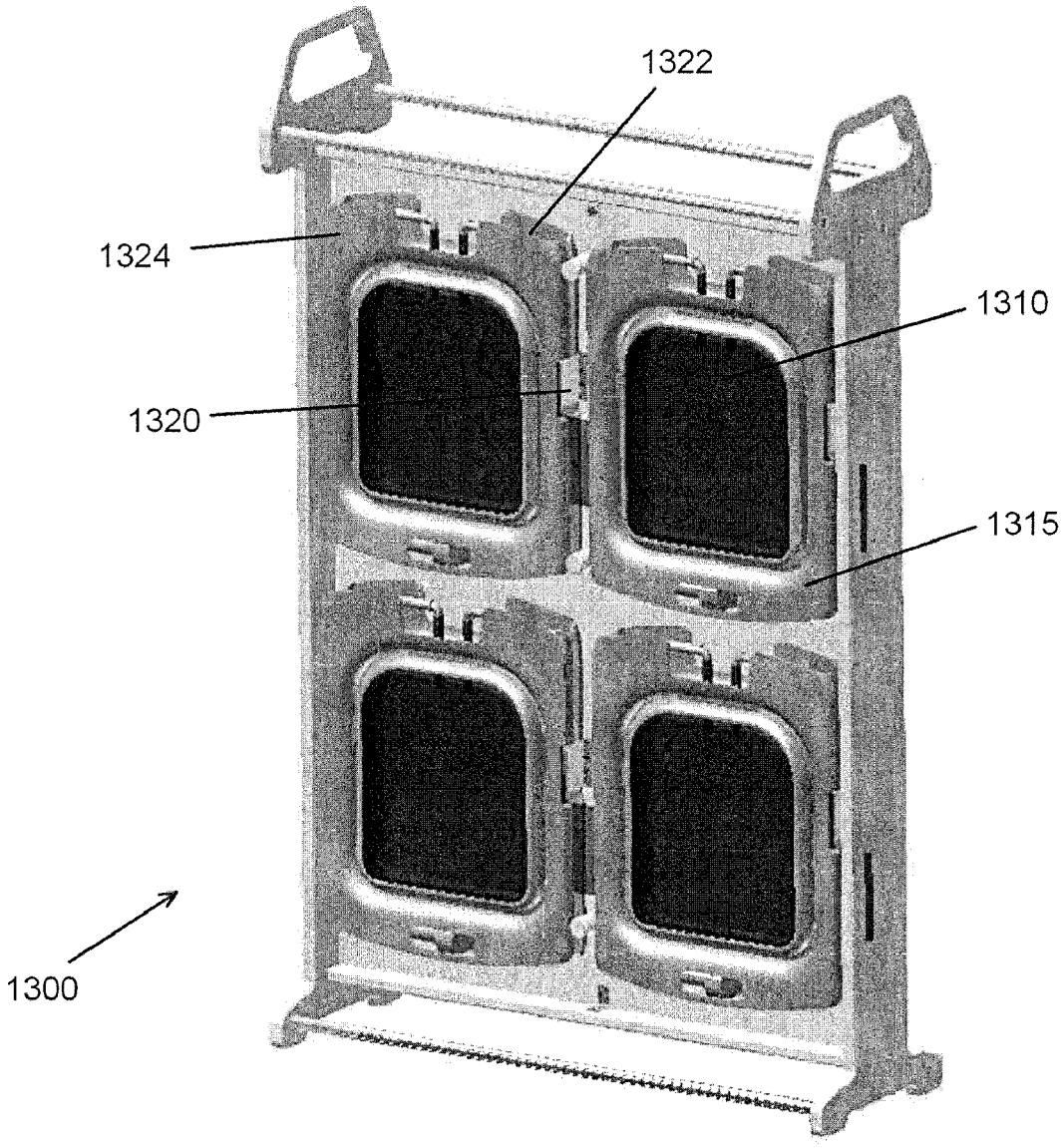
FIG. 25 is an elevational view of a plurality of holders attached to a supporting plate via a plurality of hooks in accordance with the present invention.
Figure 26:
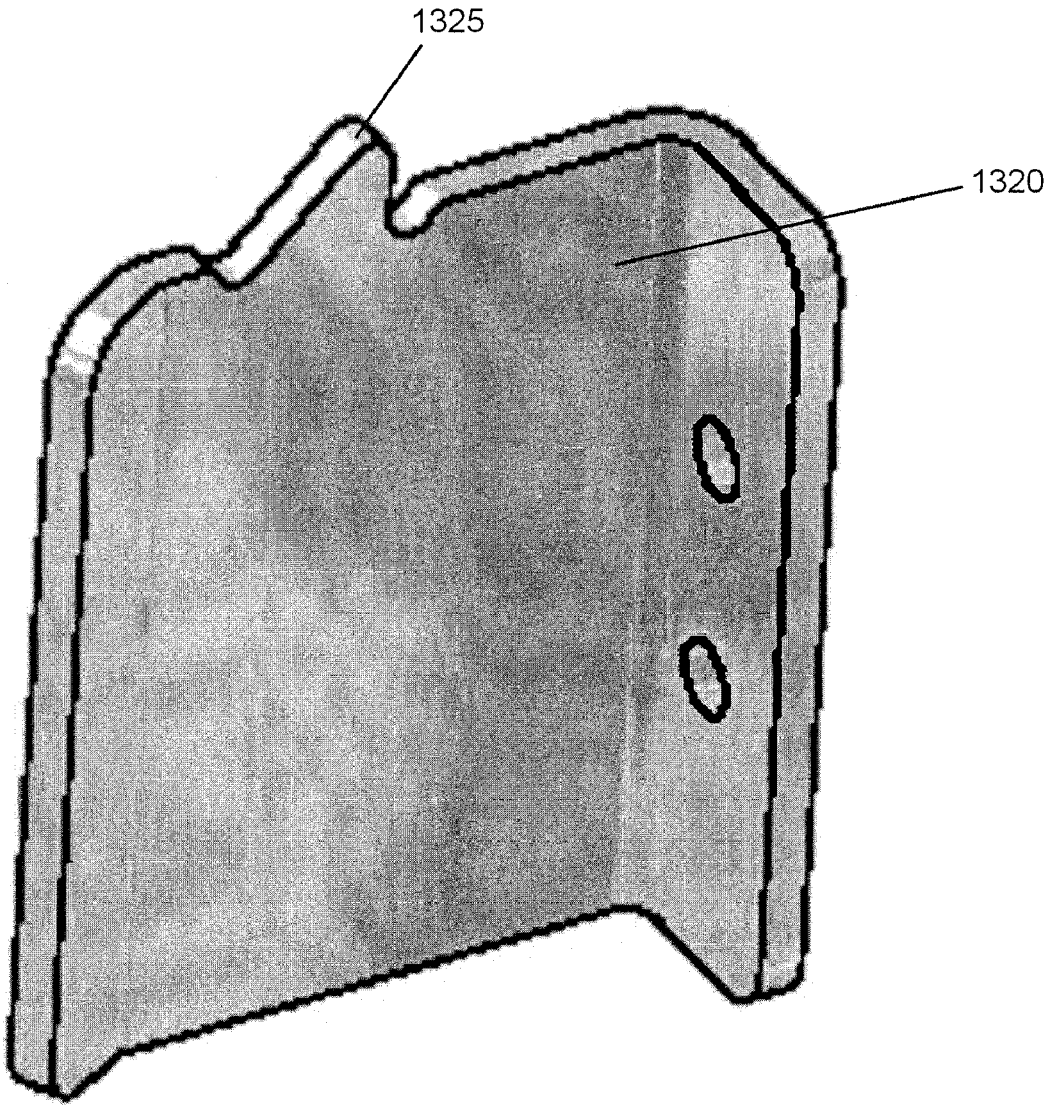
FIG. 26 is a perspective view of one of the hooks of the plate of FIG. 25.

In another example depicted in FIGS. 25-26, a plate 1300 may receive a plurality of holders 1315 holding containers 1310 similar to supporting plate 800 and supporting plate 500. Supporting plate 1300 may include a plurality of supporting hooks 1320 for holding holders 1315 and containers 1310 thereon. Hooks 1320 may include a prong 1325 which may retain holders 1315 holding containers 1310 on plate 1300. More specifically, prong 1325 may extend vertically upward into a cavity between a first portion 1322 adjacent the plate and a second portion 1324 fixedly or releasably connected thereto. The engagement of prongs 1325 in the cavity between the first and second portions may inhibit release of the holder from the hook in a direction normal to an outer surface of plate 1300.

Also, it will be understood by one skilled in the art that various holders (e.g., holder 15 and holder 615) may be integral to various sized containers (e.g., container 10 and container 610) and may be received in a temperature control unit (e.g., temperature control unit 20). Further, it will be understood to one skilled in the art that a supporting plate (e.g., plate 500) may be attached to holders (e.g., holder 15) in any number of ways which allow the holders to be selectively released therefrom. For example, the plates may include any number of pegs, connectors, clips, openings, or other means for attaching to connecting structures of one or more holders, such as peg openings, clips, fasteners, etc. Also, a supporting plate (e.g., supporting plate 500) may include structures (not shown) allowing the heat transfer plate to stand upright (e.g., maintain a vertical orientation) when attached to such holders having biopharmaceutical materials held in containers thereof. Further, the supporting plate could be any structure configured (e.g., shaped, dimensioned and formed of sufficient strength) to support the holder(s) and to be received in a temperature control unit.

Although the containers are described herein as flexible containers, the containers may be made of a semi-rigid material such as polyethylene or the like. An example of such a container could include a container similar to a standard plastic milk jug. Containers made of such similar semi-rigid materials may benefit from additional rigidity supplied by attachment (e.g., fixedly) to a holder, for example. Further, the containers whether formed of a rigid, flexible or semi-rigid material, contain outer surfaces which may contact the interior surfaces (e.g., heat transfer plates) of a temperature control unit (e.g., temperature control unit 20) so that there is direct contact between the cooled (e.g., to a subzero temperature) or heated interior surfaces of the temperature control unit and the outer surfaces of the container containing biopharmaceutical materials. Alternatively, the outer surfaces of the containers for holding the biopharmaceutical materials may be in contact with air flow in an interior (e.g., interior 25) of the temperature control unit or other means of temperature control (e.g., a blast freezer) to cause the cooling and/or heating of the containers having the biopharmaceutical materials therein to cause the temperature of the biopharmaceutical materials to be controlled.

The biopharmaceutical material in the containers described above may thus be cooled or otherwise thermoregulated (e.g., to a subzero temperature) in temperature control unit 20 or a blast freezer, for example. When such operation is completed, the containers may be removed from temperature control unit 20 by removing the containers and the holders, or other support structures which the containers are received in or connected to, for example. The holders or other support structures holding the containers may be stored in a large chiller or freezer with an interior air temperature of about negative 20 degrees Celsius, for example.

A typical process for processing and/or preserving a biopharmaceutical material is described as follows. One or more containers (e.g., containers 10, 410, 610, or 710) is integrally formed or fixedly (e.g., non-separably) connected to a holder (e.g., holders 15, 415, 615 or 715) as depicted in FIG. 5. Also, holder 15 may be aligned substantially horizontally (e.g., such that outer surfaces of first portion 115 and second portion 117 are horizontal) and biopharmaceutical material, for example liquid biopharmaceutical material, may be inserted through conduit 120 into container 10. Also, after biopharmaceutical material is received in the interior of the holder (e.g., holder 15, 415, 615 or 715) through a conduit (e.g., conduit 120), the conduit, or a portion thereof, may be removed from the holder by heat sealing the conduit of the container (e.g., container 10, 410, 610 or 710) and then cutting and removing the portion of the conduit upstream of the seal. Such sealing may inhibit or prevent the biopharmaceutical materials held in the container from being contaminated. Holder 15 may be attached to supporting plate 500 and located in temperature control unit 20, as shown in FIGS. 6-8. Plates 28 in slot 25 may contact container 10 having biopharmaceutical material therein. The biopharmaceutical contents are frozen in temperature control unit 20 in a controlled manner (e.g., to negative 20 degrees Celsius or below), for example, such that the freeze rate (including the dendritic freeze front velocity from the sides of the container to the center) is controlled within upper and lower limits, as described in co-owned U.S. Pat. No. 6,453,683, issued Sep. 24, 2002. Thus, cryoconcentration of the biopharmaceutical material is prevented or inhibited, thereby preventing undesirable degradation of the biopharmaceutical material. After the biopharmaceutical material in the container(s) is frozen, holder 15 and the container(s) may be removed with or without plate 500 from temperature control unit 20 and placed in a large freezer, for example, a walk-in freezer having an interior air temperature of about negative 20 degrees Celsius for storage, as is typically present in large medical institutions (e.g., hospitals). Also, the use of containers (e.g., container 10 and container 410) having a uniform thickness allow uniform cooling to occur within such a temperature control unit, blast freezer, or other means for controlling a temperature of the immediate surroundings of such containers.

Further, the above-described containers may be removed from a freezer or other system for storage of the flexible containers and contents thereof at a controlled temperature. These containers having biopharmaceutical material therein may then be received in a temperature control unit for heating, melting, agitating, mixing and/or thawing the biopharmaceutical material contained in the containers. For example, holder 15 supporting container 10 having frozen biopharmaceutical material therein may be placed in temperature control unit 20 where its temperature may be controlled (e.g. thawed) by heat transfer plate(s) 28. In addition, holder 15 or supporting plate 500 on which holders 15 are secured may be submitted to gentle mixing inside temperature control unit 20 to accelerate the thawing kinetics and to minimize any solute concentration gradient in the thawed liquid. Also, when use of the biopharmaceutical materials held in the container (e.g., containers 10, 410, 610 or 710) is desired, and if the conduit is previously at least partially removed and sealed, the remaining portion of the conduit or other portion of the container may be pierced or otherwise opened to allow fluid communication between an interior or an exterior thereof such that biopharmaceutical materials may be removed.

From the above description, it will be understood to one skilled in the art that the containers described herein may be adapted for use in holders, storage units, support structures, transportation devices, temperature control units, heat exchangers, vessels, and/or processors of various shapes or sizes. Further, the holders, containers, support structures, heat exchangers, temperature control units, and/or processors may be adapted to receive containers of various shapes or sizes. These holders or support structures may be configured for long or short term storage of the containers containing biopharmaceutical materials in liquid or frozen state, or may be adapted to transport the flexible containers containing biopharmaceutical materials in liquid or frozen state. For example, the temperature control unit may be insulated to allow the material to remain at a given temperature for a prolonged period of time. Furthermore, these holders, containers, support structures, temperature control units, heat exchangers, and/or processors may be adapted for utilization with materials other than biopharmaceutical materials. Finally, the storage containers, support structures, temperature control units, or holders may be equipped with various transport mechanisms, such as wheels, glides, sliders, dry-ice storage compartments or other devices to facilitate transport and organization thereof.

While the invention has been depicted and described in detail herein, it will be apparent to those skilled in the relevant art that various modifications, additions, substitutions and the like can be made without departing from the spirit of the invention and these are therefore considered to be within the scope of the invention as defined in the following claims.

The invention claimed is:

1. A system for use in freezing, storing and thawing biopharmaceutical materials, said system comprising:

a container means for holding biopharmaceutical material therein;

a holder having a cavity, said container means received in said cavity, said holder comprising a first inner support rim extending along a perimeter of said container means and supporting said container means;

said holder comprising a second inner support rim extending along said perimeter of said container means, said container means located between said first inner support rim and said second inner support rim; and said first inner support rim separated from an outside holder perimeter of said holder by a surrounding portion of said holder, said outside holder perimeter located outwardly from said first inner support rim in a direction opposite from said cavity, said surrounding portion being configured to inhibit stress and damage to said container means resulting from an impact or a stress to said holder, said surrounding portion forming a second cavity between said first inner support rim and said outside holder perimeter, and said second cavity being isolated from said container means and unoccupied by said container means, said second cavity extending around said perimeter of said container means.

2. The system of claim 1 wherein said holder comprises a first side and a second side and wherein said container means is received between said first side and said second side to connect said container means to said holder.

3. The system of claim 2 wherein said second cavity is bounded by said first side, said second side, and said holder perimeter.

4. The system of claim 1 wherein said holder comprises a first side and a second side, said first side comprising said rim and said second side comprising said second support rim.

5. The system of claim 1 wherein said holder comprises a first connecting surface and a second connecting surface and wherein said container means is received between said first surface and said second surface to connect said container means to said holder.

6. The system of claim 5 wherein said first connecting surface and said second connecting surface are spaced from said holder perimeter by said surrounding portion.

7. The system of claim 1 wherein said holder comprises a first side and a second side and further comprising a space between at least a portion of said first side and at least a portion of said second side, said holder being elastically deformable toward said space to inhibit damage of said container means in response to said holder impacting an object.

8. The system of claim 1 further comprising a cover connected to said first inner support rim to protect said container means and allow heat transfer through said cover to said container means.

9. The system of claim 8 further comprising a second holder having a third rim and a second cover connected to said third rim, said holder being stacked on said second holder such that said cover abuts said second cover and said cover and said second cover provide structural support to said holder and said second cover to inhibit damage to said container means and to a second container means located in a third cavity of said second holder.

10. The system of claim 1 wherein said first inner support rim comprises a concave portion supporting said container means.

11. The system of claim 1 wherein said surrounding portion is elastically deformable to inhibit the stress and damage to said container means.

12. The system of claim 1 further comprising at least one conduit located in said second cavity and in fluid communication with an interior of said container means.

13. The method of claim 1 further comprising locating at least one conduit in the second cavity in fluid communication with an interior of said container means.

14. A method for use in freezing, storing and thawing biopharmaceutical materials, the system comprising:

providing a container means for holding biopharmaceutical material therein;

receiving the container means in a cavity of a holder, the holder comprising a first support rim extending along a perimeter of the container means and supporting the container means;

a second support rim of the holder extending along the perimeter of the container means, the container means located between the first support rim and the second support rim;

the first support rim separated from an outside holder perimeter of the holder by a surrounding portion of the holder;

the outside holder perimeter located outwardly from said first support rim in a direction opposite from said cavity;

the surrounding portion forming a second cavity between the first support rim and the holder perimeter, the second cavity isolated from the container means and unoccupied by the container means, the second cavity extending around the perimeter of the container means; and the surrounding portion inhibiting stress and damage to the container means resulting from an impact or a stress to the holder.

15. The method of claim 14 wherein the holder comprises a first side and a second side and wherein the receiving step further comprises receiving the container between the first side and the second side to connect the container means to the holder.

16. The system of claim 15 wherein the second cavity is bounded by the first side, the second side, and the holder perimeter.

17. The method of claim 14 further comprising connecting the container to the holder by receiving the container between a first connecting surface and a second connecting surface of the holder.

18. The method of claim 14 further comprising elastically deforming a portion of the holder toward a space between at least a portion of a first side and at least a portion of a second side of the holder to inhibit damage to the container in response to the holder impacting an object.

19. The method of claim 14 further comprising connecting a cover to the first support rim to protect the container and allow heat transfer through the cover to the container.

20. The method of claim 19 further comprising connecting a second cover to a third rim of a second holder and stacking the holder on the second holder such that the cover abuts the second cover and such that the cover and the second cover provide structural support to the holder and the second cover to inhibit damage to the container and to a second container located in a third cavity of the second holder.

21. A system for use in freezing, storing and thawing biopharmaceutical materials, said system comprising:

a container means for holding biopharmaceutical materials therein;

a holder having a cavity, said container means received in said cavity, said holder comprising an inner support rim extending along a perimeter of said container means and supporting said container means;

said container means having a connecting portion connected to said holder and a receiving portion receiving the biopharmaceutical materials;

said holder comprising a second inner support rim extending along a perimeter of said container means, said container means located between said inner support rim and said second inner support rim; and said inner support rim separated from an outside holder perimeter of said holder by a surrounding portion of said holder, said outside holder perimeter located outwardly from said inner support rim in a direction opposite from said cavity, said surrounding portion being configured to inhibit stress and damage to said container means resulting from an impact or a stress to said holder, said surrounding portion forming a second cavity between said inner support rim and said outside holder perimeter, and said second cavity unoccupied by said receiving portion of said container means, said second cavity extending around a perimeter of said container means.

22. A method for use in freezing, storing and thawing biopharmaceutical materials, the system comprising:

providing a container means for holding biopharmaceutical material therein;

receiving the container means in a cavity of a holder, the holder comprising a support rim extending along a perimeter of the container means and supporting the container means;

connecting a connecting portion of the container means to the holder and a receiving portion of the container means receiving the biopharmaceutical materials;

a second support rim of the holder extending along a perimeter of the container means, the container means located between the support rim and the second support rim;

the support rim separated from an outside holder perimeter of the holder by a surrounding portion of the holder;

the outside holder perimeter located outwardly from said support rim in a direction opposite from said cavity;

the surrounding portion forming a second cavity between the rim and the holder perimeter, the second cavity unoccupied by the receiving portion of the container means, the second cavity extending around a perimeter of the container means; and the surrounding portion inhibiting stress and damage to the container means resulting from an impact or a stress to the holder.

* * * * *